US011846478B2

(12) United States Patent
Kloepfer et al.

(10) Patent No.: US 11,846,478 B2
(45) Date of Patent: Dec. 19, 2023

(54) ELECTROMECHANICAL SEAR AND METHODS OF OPERATING A GUN USING THE SAME

(71) Applicant: Biofire Technologies Inc., Broomfield, CO (US)

(72) Inventors: Kai Thorin Kloepfer, Denver, CO (US); Donna Kelley, Louisville, CO (US); Sara Elizabeth Falcone, Lafayette, CO (US); Katherine Joanne Lund, Westminster, CO (US); Jack Hugo Thiesen, Firestone, CO (US); Timothy Joel Thorson, Castle Rock, CO (US); Benjamin William Dwyer, Golden, CO (US); Christopher James Owens, Denver, CO (US); Joseph Ray Wilding, Castle Rock, CO (US); Karl Fredrick Brakora, Spring Lake, MI (US); John Andrew Tomasik, Golden, CO (US)

(73) Assignee: Biofire Technologies Inc., Broomfield, CO (US)

( * ) Notice: Subject to any disclaimer, the term of this patent is extended or adjusted under 35 U.S.C. 154(b) by 0 days.

(21) Appl. No.: 17/933,810

(22) Filed: Sep. 20, 2022

(65) Prior Publication Data

US 2023/0010645 A1 Jan. 12, 2023

Related U.S. Application Data

(63) Continuation of application No. 17/655,527, filed on Mar. 18, 2022, now Pat. No. 11,473,866.

(Continued)

(51) Int. Cl.
*F41A 19/59* (2006.01)
*F41A 17/06* (2006.01)

(52) U.S. Cl.
CPC ..... *F41A 19/59* (2013.01); *F41A 17/066* (2013.01)

(58) Field of Classification Search
CPC ..... F41A 19/59; F41A 17/066; F41A 19/58; F41A 17/06
See application file for complete search history.

(56) References Cited

U.S. PATENT DOCUMENTS 2,337,145 A * 12/1943 Albree ..... F41A 19/59 42/106
3,626,624 A 12/1971 Green
(Continued)

*Primary Examiner* — Joshua E Freeman
(74) *Attorney, Agent, or Firm* — Perkins Coie LLP; Andrew T. Pettit; Brian Coleman

(57) ABSTRACT

The present disclosure provides systems and techniques for an electromechanical sear that is implementable in a gun. The gun may include a fire control manager, and the fire control manager may identify a trigger break based on a trigger sensor, transmit, based on the trigger break, a first signal to a first actuator located in a displacement path of a sear, so as to cause the first actuator to be displaced in a first direction, and transmit, based on the trigger break, a second signal to a second actuator located in the displacement path of the sear, so as to cause the second actuator to be displaced in a second direction. The transmitting the first signal to the first actuator and the transmitting the second signal to the second actuator may cause displacement of the sear and firing of the gun.

15 Claims, 13 Drawing Sheets

Related U.S. Application Data

(60) Provisional application No. 63/165,700, filed on Mar. 24, 2021.

(56) References Cited

U.S. PATENT DOCUMENTS 3,738,043 A 6/1973 Green
3,888,021 A * 6/1975 McCurdy ..... F41A 19/59 434/19
4,009,536 A * 3/1977 Wolff ..... F41A 19/59 89/135
4,275,521 A * 6/1981 Gerstenberger ..... F41A 19/58 42/84
4,296,564 A 10/1981 Oberst
4,347,679 A * 9/1982 Grunig ..... F41A 19/58 42/84
4,793,085 A * 12/1988 Surawski ..... F41A 19/58 42/84
5,386,659 A * 2/1995 Vaid ..... F41A 19/32 42/69.02
5,713,150 A 2/1998 Ealovega
6,425,199 B1 * 7/2002 Vaid ..... F41A 19/69 42/84
6,626,165 B1 9/2003 Bhogal
6,802,305 B1 * 10/2004 Hatcher ..... F41A 19/17 124/31
8,578,922 B1 11/2013 Granger
10,240,881 B1 * 3/2019 Galie ..... F41A 19/59
2003/0221684 A1 * 12/2003 Rice ..... F41A 19/59 124/71
2010/0186277 A1 * 7/2010 Beckmann ..... F41A 19/69 42/84
2011/0005118 A1 1/2011 Powers
2011/0259183 A1 10/2011 Compton et al.
2011/0271574 A1 * 11/2011 Chang ..... F41A 17/066 42/70.08
2013/0112183 A1 * 5/2013 Arnedo Vera ..... F41B 11/71 124/32
2013/0118050 A1 5/2013 Alicea et al.
2013/0167423 A1 7/2013 Lupher et al.
2016/0061549 A1 * 3/2016 Patterson ..... F41A 19/12 42/69.01
2016/0084601 A1 * 3/2016 Alicea, Jr. ..... F41A 19/10 42/6
2017/0089656 A1 3/2017 Alicea
2017/0219305 A1 8/2017 Roberts
2018/0259285 A1 * 9/2018 Galie ..... F41A 17/06
2019/0041151 A1 * 2/2019 Folk ..... F41A 19/10
2019/0186857 A1 6/2019 Galie et al.
2019/0346226 A1 11/2019 Shneorson et al.
2020/0348098 A1 11/2020 Galie et al.
2020/0363151 A1 * 11/2020 Murphy, II ..... F41C 23/10
2021/0140733 A1 5/2021 Herskowitz et al.

* cited by examiner

100

200

700

900

1000

1100

1300

ELECTROMECHANICAL SEAR AND METHODS OF OPERATING A GUN USING THE SAME

CROSS-REFERENCE TO RELATED APPLICATIONS

This application is a continuation of U.S. patent application Ser. No. 17/655,527, titled "ELECTROMECHANICAL SEAR AND METHODS OF OPERATING A GUN USING THE SAME" and filed on Mar. 18, 2022, which claims the benefit of priority to U.S. Provisional Application No. 63/165,700, titled ""ELECTROMECHANICAL SEAR" and filed on Mar. 24, 2021, which are incorporated by reference herein in their entireties.

FIELD OF TECHNOLOGY

The teachings disclosed herein generally relate to guns, and more specifically to an electromechanical sear.

BACKGROUND

The term "gun" generally refers to a ranged weapon that uses a shooting tube (also referred to as a "barrel") to launch solid projectiles, though some instead project pressurized liquid, gas, or even charged particles. These projectiles may be free flying (e.g., as with bullets), or these projectiles may be tethered to the gun (e.g., as with spearguns, harpoon guns, and electroshock weapons such as TASER® devices). The means of projectile propulsion vary according to the design (and thus, type of gun), but are traditionally effected pneumatically by a highly compressed gas contained within the barrel. This gas is normally produced through the rapid exothermic combustion of propellants (e.g., as with firearms) or mechanical compression (e.g., as with air guns). When introduced behind the projectile, the gas pushes and accelerates the projectile down the length of the barrel, imparting sufficient launch velocity to sustain it further towards a target after exiting the muzzle.

Most guns used compressed gas that is confined by the barrel to propel the projectile up to high speed, though the term "gun" may be used more broadly in relation to devices that operate in other ways. Accordingly, the term "gun" may not only cover handguns, shotguns, rifles, single-shot firearms, semi-automatic firearms, and automatic guns, but also electroshock weapons, light-gas guns, plasma guns, and the like.

Significant energies have been spent developing safer ways to use, transport, store, and dispose guns. Gun safety is an important aspect of avoiding unintentional injury due to mishaps like accidental discharges and malfunctions. Gun safety is also becoming an increasingly important aspect of designing and manufacturing guns. While there have been many attempts to make guns safer to use, transport, and store, those attempts have had little impact.

SUMMARY

The systems and techniques described herein support an electromechanical sear that is implementable in a gun. An electromechanical sear may improve gun safety, as a gun with an electromechanical sear can include multiple robust safety features. The term "gun," used herein, may be used to refer to a lethal force weapon, such as a pistol, a rifle, a shotgun, a semi-automatic gun, or an automatic gun; a less-lethal weapon, such as a stun-gun or a projectile emitting device; or an assembly of components operable to selectively discharge matter or charged particles, such as a firing mechanism.

Generally, the described systems and techniques described herein provide for controllably firing a projectile from a gun. The gun may include a sear component that is rotatable between a first position and a second position, a first actuator that is positioned so as to retain the sear component in the first position, where upon receiving a first signal, the first actuator is configured to move in a first direction, and a second actuator that is positioned so as to retain the sear component in the first position, where upon receiving a second signal, the second actuator is configured to move in a second direction different than the first direction. The sear component may be configured to rotate from the first position to the second position based on the first actuator moving in the first direction and the second actuator moving in the second direction. The first actuator and the second actuator may be configured in a complementary fashion so as to inhibit accidental discharge and improve gun safety.

Figure 1:
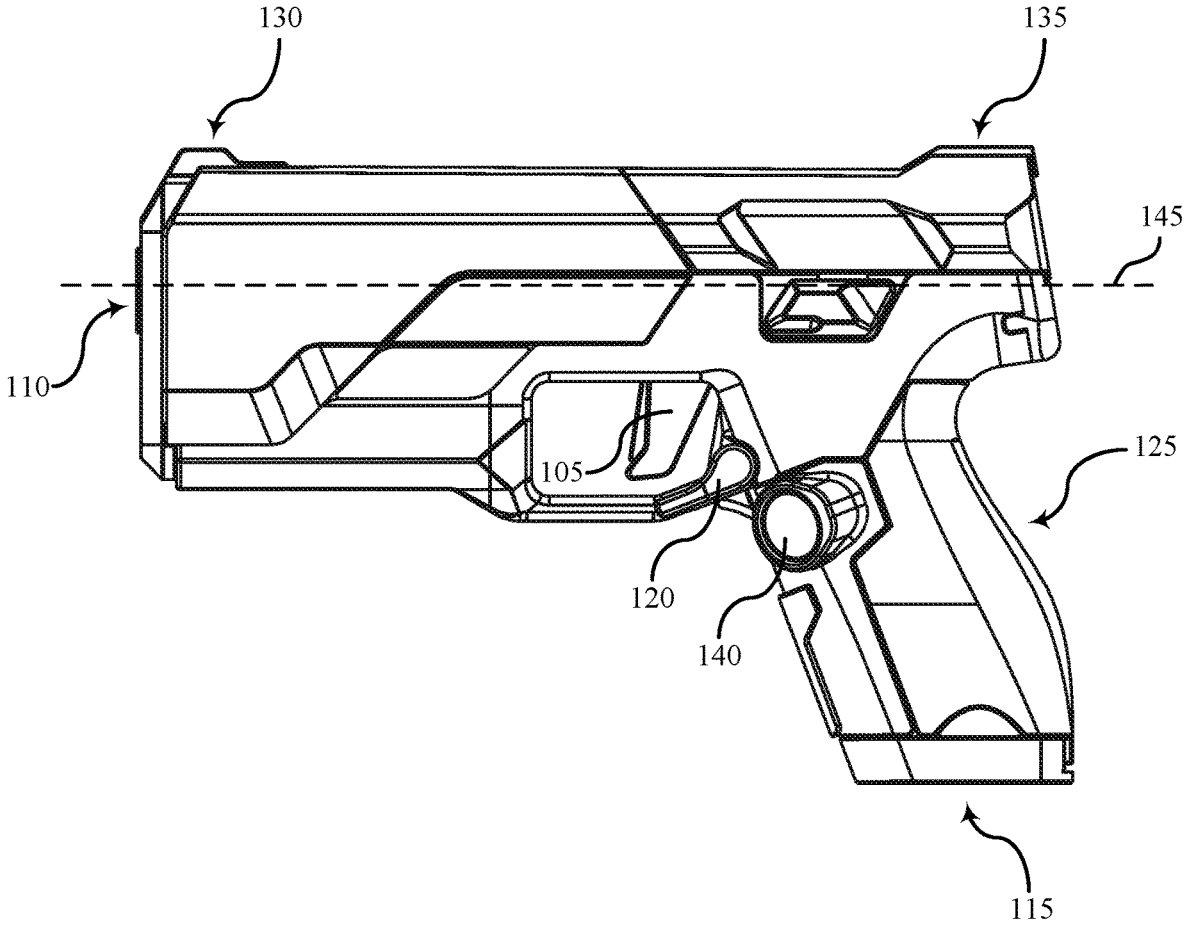
FIG. 1 illustrates an example of a gun that supports an electromechanical sear in accordance with aspects of the present disclosure.

Various features of the technology described herein will become more apparent to those skilled in the art from a study of the Detailed Description in conjunction with the drawings. Various embodiments are depicted in the drawings for the purpose of illustration. However, those skilled in the art will recognize that alternative embodiments may be employed without departing from the principles of the technology. Accordingly, the technology is amenable to modifications that may not be reflected in the drawings.

DETAILED DESCRIPTION

In conventional guns, the sear is used to retain the striker, hammer, or bolt until the correct amount pressure has been applied to the trigger, at which point the striker, hammer, or bolt is released to fire the gun. For example, a conventional sear could include a first mechanical element (e.g., a bar) that is able to rest in a complementary structural feature (e.g., a notch) in a second mechanical element (e.g., a hammer or a striker). In operation, the first mechanical element holds the second mechanical element under tension, and when the trigger is pulled, the first mechanical element moves out of the complementary structural feature, releasing the second mechanical element such that the second mechanical element collides with a cartridge primer, ignites the propellant, and fires the gun.

Various sears have been used in conventional firearms. For example, single-action revolvers include a single sear for releasing the hammer, while double-action revolvers include a pair of sears—one for single-action release and another for double-action release. Some select-fire rifles also include a pair of sears—one for semi-automatic fire and another for full-automatic fire.

Sears play a key role in regulating, controlling, or otherwise managing the firing action in conventional firearms. Conventional sears suffer from drawbacks, however. Both the trigger weight and the trigger feel are influenced by the sear, as the first mechanical element is moved out of the complementary structural feature in response to a user pulling the trigger. Since the sear is mechanically coupled with the hammer or striker in most conventional firearms, safety is often comprised for improved trigger feel, since a light trigger weight comes at the expense of a tenuous locking of the sear and the striker or hammer. As such, conventional sear mechanisms yield trigger profiles that are often undesirable with little room for modification.

Some conventional electromechanical guns include an inhibitor mechanism to attempt to deliver improved safety. But inhibition-based guns—namely, guns that engage an inhibitor mechanism to inhibit movement of a component (such as a trigger) while the gun is unarmed and disengage the inhibitor mechanism to arm the gun—utilize a holding current to either engage the inhibitor mechanism while the gun is unarmed or disengage the inhibitor mechanism while the gun is armed. In either case, the holding current may be present for hours or days at a time, thereby resulting in a significant drain on power and reducing the amount of time for which the gun can be used. Additionally, an inhibitor mechanism can often be defeated by simply removing the inhibitor from the gun. For example, an inhibition-based gun may include a bar that inhibits (or simply blocks) movement of the trigger while the gun is unarmed, and a holding current may be used to hold the bar in a different location such that the trigger is not inhibited by the bar so the gun can function as normal while the gun is armed. If a thief steals the gun and removes the inhibitor bar that is used to inhibit movement of the trigger, then the gun loses the safety benefits originally provided by the inhibitor mechanism.

Introduced here, therefore, is an electromechanical sear mechanism including a sear component (or simply "sear") that is controllable between a first position (also referred to as a "default position") and a second position (also referred to as an "action position") using a pair of actuators. The actuators may be electrical actuators, which are mechanical devices that can convert electricity into kinetic energy via linear or rotary motion. In operation, the actuators are activated in response to electrical pulses. An electrical pulse may be transmitted through an actuator solenoid (or simply "solenoid") or a piezoelectric element to activate the actuator. For example, an electrical pulse may be transmitted through a solenoid of an actuator in response to a trigger break, and the actuator may be activated in response to the electrical pulse. The electrical current passing through the solenoid creates a magnetic field, which results in activation of the actuator as an actuator plunger (or simply "plunger") is displaced in response to the magnetic field. Activating the actuators allows the release of the sear component, which results in the gun being fired. Electrical pulses can be transmitted in response to determining that an event has occurred. Examples of events include identifying a trigger break, discovering the presence of a user, or determining that a user is authorized to operate the gun. Accordingly, electrical pulses may be transmitted in response to a trigger break when an authorized user is holding the gun.

As mentioned above, the sear may be retained by two actuators, and the two actuators may be configured in a complementary fashion to improve gun safety. While in the default position, the actuators obstruct the sear so as to prevent the sear from releasing the striker or hammer. However, upon activation, the actuators are moved so as to allow the sear to release the striker or hammer. One actuator may move in one direction (e.g., forward with respect to the gun) while the other actuator may move in the opposite direction (e.g., backward with respect to the gun), thereby improving gun safety. Configuring the actuators in a complementary fashion improves the drop safety of the gun, as force acting against one of the actuators will be working with the other actuator.

In some examples, the sear is retained by one actuator, and an additional safety component is used to enhance the overall safety of the gun. For example, the actuator may obstruct movement of the sear while in a default position, and an additional safety component (e.g., a firing pin safety or a trigger safety) may block the firing pin or prevent the trigger from moving while in a default position. The actuator may be electrical while the additional safety may be mechanical, thereby improving the safety of the gun by including multiple disparate safeties. Maintaining the actuator in the default position obstructs the movement of the sear and prevents the gun from firing, while activating the actuator such that the actuator transitions to an action position allows the sear to move and the gun to fire. Maintaining the actuator in the default position obstructs the sear from moving sufficiently so as to allow the striker or hammer to release and the gun to fire, although some movement of the sear may occur while the sear is in the default position.

Each of the one or more actuators may include, or be coupled with, a spring that applies force to the actuator. The spring may be configured to apply force onto the actuator such that the actuator is positioned in the default position while inactivate (e.g., an activating electrical pulse is absent). Additionally, the force applied by the spring may move the actuator from the action position back to the default position following the activation of the actuator and the firing of a projectile (e.g., a round of ammunition) from the gun.

Embodiments may be described in the context of executable instructions for the purpose of illustration. For example, a fire control manager housed in a gun may be described as being capable of implementing logic, processing signals, or executing instructions that permit the transmitting of an electrical pulse, activating of an actuator, and the firing of the gun. However, those skilled in the art will recognize that aspects of the technology could be implemented via hardware, firmware, or software.

Terminology

References in the present disclosure to "an embodiment" or "some embodiments" means that the feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the terms "comprise," "comprising," and "comprised of" are to be construed in an inclusive sense rather than an exclusive or exhaustive sense (i.e., in the sense of "including but not limited to"). The term "based on" is also to be construed in an inclusive sense rather than an exclusive or exhaustive sense. For example, the phrase "A is based on B" does not imply that "A" is based solely on "B." Thus, the term "based on" is intended to mean "based at least in part on" unless otherwise noted.

The terms "connected," "coupled," and variants thereof are intended to include any connection or coupling between two or more elements, either direct or indirect. The connection or coupling can be physical, logical, or a combination thereof. For example, elements may be electrically or communicatively coupled with one another despite not sharing a physical connection. As one illustrative example, a first component is considered coupled with a second component when there is a conductive path between the first component and the second component. As another illustrative example, a first component is considered coupled with a second component when the first component and the second component are fastened, joined, attached, tethered, bonded, or otherwise linked.

The term "manager" may refer broadly to software, firmware, or hardware. Manager are typically functional components that generate one or more outputs based on one or more inputs. A computer program may include or utilize one or more manager. For example, a computer program may utilize multiple manager that are responsible for completing different tasks, or a computer program may utilize a single manager that is responsible for completing all tasks. As another example, a manager may include an electrical circuit that produces an output based on hardware components, such as transistors, logic gates, analog components, or digital components. Unless otherwise noted, the terms "manager" and "module" may be used interchangeably.

When used in reference to a list of multiple items, the term "or" is intended to cover all of the following interpretations: any of the items in the list, all of the items in the list, and any combination of items in the list. For example, the list "A, B, or C" indicates the list "A" or "B" or "C" or "A and B" or "A and C" or "B and C" or "A and B and C."

Overview of Guns

FIG. 1 illustrates an example of a gun 100 that supports an electromechanical sear in accordance with aspects of the present disclosure. The gun 100 includes a trigger 105, a barrel 110, a magazine 115, and a magazine release 120. While these components are generally found in firearms, such as pistols, rifles, and shotguns, those skilled in the art will recognize that the technology described herein may be similarly appliable to other types of guns as discussed above. As an example, comparable components may be included in vehicle-mounted weapons that are not intended to be held or operated by hand. While not shown in FIG. 1, the gun 100 may also include a striker (e.g., a ratcheting striker or rotating striker) or a hammer that can be actuated in response to pulling the trigger 105. Pulling the trigger 105 may result in the release of the striker or hammer, thereby causing the striker or hammer to drive a firing pin into a primer or percussion cap, so as to ignite a propellant and fire a projectile through the barrel 110. Embodiments of the gun 100 may also include a blowback system, a locked breech system, or any combination thereof. These systems are more commonly found in self-reloading firearms. The blowback system may be responsible for obtaining energy from the motion of the case of the projectile as it is pushed to the rear of the gun 100 by expanding propellant, while the locked breech system may be responsible for slowing down the opening of the breech of a self-reloading firearm when fired. Accordingly, the gun 100 may support the semi-automatic firing of projectiles, the automatic firing of projectiles, or both.

The gun 100 may include one or more safeties that are meant to reduce the likelihood of an accidental discharge or an unauthorized use of the gun 100. The gun 100 may include one or more mechanical safeties, such as a trigger safety or a firing pin safety. The trigger safety may be incorporated in the trigger 105 to prevent the trigger 105 from moving unintentionally or in response to lateral force placed on the trigger 105 or dropping the gun. The term "lateral force," as used herein, may refer to a force that is substantially orthogonal to a central axis 145 that extends down the barrel 110 from the front to the rear of the gun 100. The firing pin safety may block the displacement path of the firing pin until the trigger 105 is pulled. Additionally or alternatively, the gun 100 may include one or more electrical safety components, such as an electronically actuated drop safety or an electronically actuated firing pin safety. In some cases, the gun 100 may include both mechanical and electrical safeties to reduce the potential for an accidental discharge and improve the overall safety of the gun 100.

The gun 100 may include one or more sensors, such as a user presence sensor 125 and a biometric sensor 140. In some cases, the gun 100 may include multiple user presence sensors 125 whose outputs can collectively be used to detect the presence of a user. For example, the gun 100 may include a time of flight (TOF) sensor, a photoelectric sensor, a capacitive sensor, an inductive sensor, a force sensor, a resistive sensor, or a mechanical switch. As another example, the gun 100 may include a proximity sensor that is configured to emit an electromagnetic field or electromagnetic radiation, like infrared, and looks for changes in the field or return signal. As another example, the gun 100 may include an audio input mechanism that is configured to generate a signal that is representative of nearby sounds, and the presence of the user can be detected based on an analysis of the signal.

The gun 100 may also include one or more biometric sensors 140 as shown in FIG. 1. For example, the gun 100 may include a fingerprint sensor (also referred to as a "fingerprint scanner"), an image sensor, or an audio input mechanism. The fingerprint scanner may generate a digital image (or simply "image") of the fingerprint pattern of the user, and the fingerprint pattern can be examined (e.g., on the gun 100 or elsewhere) to determine whether the user should be verified. The image sensor may generate an image of an anatomical feature (e.g., the face or eye) of the user, and the image can be examined (e.g., on the gun 100 or elsewhere) to determine whether the user should be verified. Normally, the image sensor is a charge-coupled device (CCD) or complementary metal-oxide semiconductor (CMOS) sensor that is included in a camera module (or simply "camera") able to generate color images. The image sensor need not necessarily generate images in color, however. In some embodiments, the image sensor is configured to generate ultraviolet, infrared, or near infrared images. Regardless of its nature, images generated by the image sensor can be used to authenticate the presence or identity of the user. As an example, an image generated by a camera may be used to perform facial recognition of the user. The audio input mechanism may generate a signal that is representative of audio containing the voice of the user, and the signal can be examined (e.g., on the gun 100 or elsewhere) to determine whether the user should be verified. Thus, the signal generated by the audio input mechanism may be used to perform speaker recognition of the user. Including multiple biometric sensors in the gun 100 may support a robust authentication procedure that functions in the event of sensor failure, thereby improving gun reliability. Note, however, that each of the multiple biometric sensors may not provide the same degree or confidence of identity verification. As an example, the output produced by one biometric sensor (e.g., an audio input mechanism) may be used to determine whether a user is present while the output produced by another biometric sensor (e.g., a fingerprint scanner or image sensor) may be used to verify the identity of the user in response to a determination that the user is present.

The gun 100 may support various types of aiming sights (or simply "sights"). At a high level, a sight is an aiming device that may be used to assist in visually aligning the gun 100 (and, more specifically, its barrel 110) with a target. For example, the gun 100 may include iron sights that improve aim without the use of electrical optics. Additionally or alternatively, the gun 100 may include telescopic sights, electrical sights, reflex sights, or laser sights. In FIG. 1, the gun 100 includes two sights—namely, a front sight 130 and a rear sight 135. In some cases, the front sight 130 or the rear sight 135 may be used to indicate gun state information. For example, the front sight 130 may include an illuminant that is able to emit light of different colors to indicate different gun states. One example of an illuminant is a light-emitting diode (LED).

The gun 100 may fire projectiles, and the projectiles may be associated with lethal force or less-lethal force. For example, the gun 100 may fire projectiles containing lead, brass, copper, zinc, steel, plastic, rubber, synthetic polymers (e.g., nylon), or a combination thereof. In some examples, the gun 100 is configured to fire lethal bullets containing lead, while in other examples, the gun 100 is configured to fire less-lethal bullets containing rubber. As mentioned above, the technology described herein may also be used in the context of a gun that fires prongs (also referred to as "darts") which are intended to contact or puncture the skin of a target and then carry electric current into the body of the target. These guns are commonly referred to as "electronic control weapons" or "electroshock weapons." One example of an electroshock weapon is a TASER device.

As further discussed herein, the gun 100 may include a fire control manager that implements firing logic. In some examples, the fire control manager may fire the gun 100 based on determining that a fingerprint collected at the biometric sensor 140 corresponds to an authorized user and determining that the user has pulled the trigger 105. The fire control manager may identify a trigger break based on a trigger sensor, such as a Hall effect sensor. The trigger sensor may be located proximate to the trigger 105. The fire control manager may transmit, based on the trigger break, a first signal to a first actuator located in a displacement path of a sear, so as to cause the first actuator to be displaced in a first direction, and transmit, based on the trigger break, a second signal to a second actuator located in the displacement path of the sear, so as to cause the second actuator to be displaced in a second direction. The transmitting the first signal to the first actuator and the transmitting the second signal to the second actuator may cause displacement of the sear and firing of the gun such that a projectile (e.g., a bullet) is propelled through the barrel 110.

Figure 2:
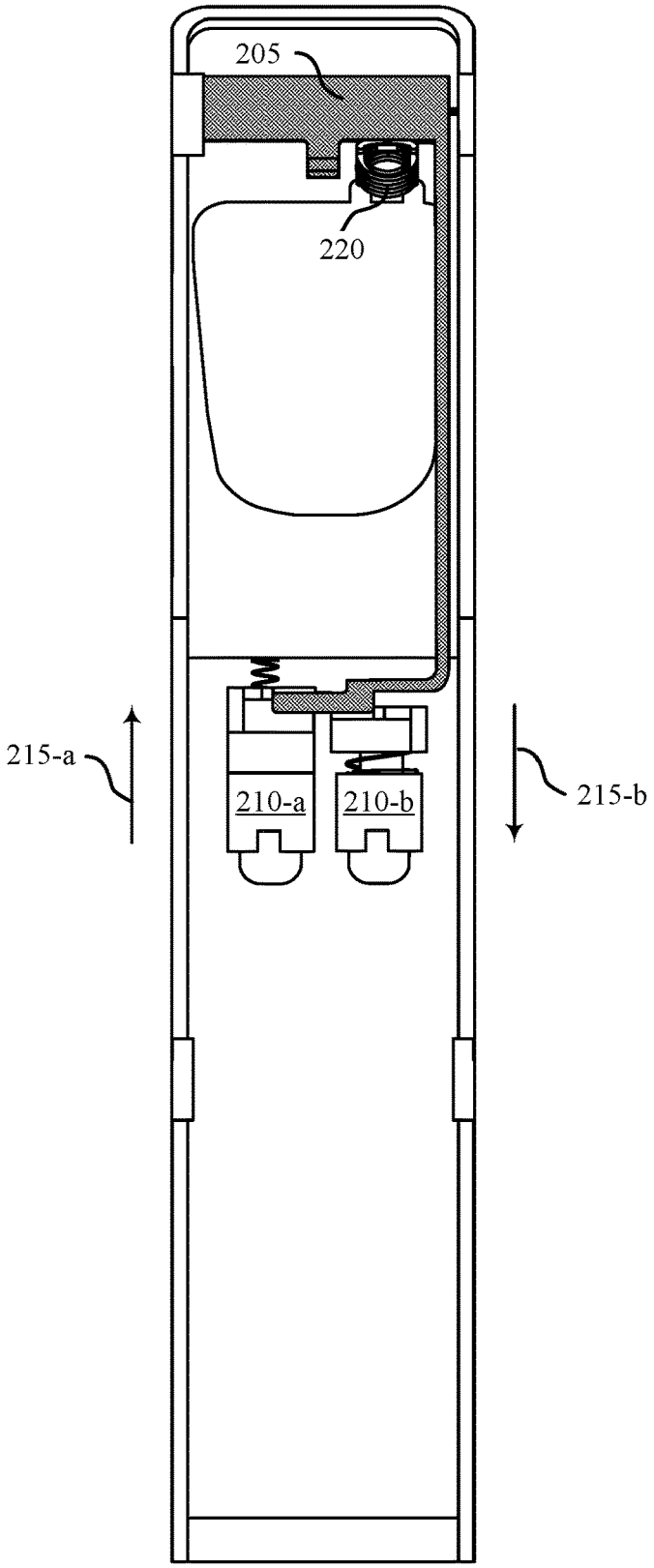
FIG. 2 illustrates an example of a fire control system that supports an electromechanical sear in accordance with aspects of the present disclosure.

FIG. 2 illustrates an example of a fire control system 200 that supports an electromechanical sear in accordance with aspects of the present disclosure. The fire control system 200 may be an aspect of the gun 100 as described with reference to FIG. 1. As illustrated in the fire control system 200, two actuators may be used to retain and release the sear 205 (e.g., also referred to as a "sear component"). The fire control system 200 includes the sear 205, the actuator 210-*a*, the actuator 210-*b*, and the spring 220.

The actuator 210-*a* and the actuator 210-*b* may retain the sear 205 in a first position (e.g., a default position) by obstructing movement of the sear 205, and the actuator 210-*a* and the actuator 210-*b* may activate such that the sear 205 is able to move to a second position (e.g., an action position). The sear 205 moving to the action position may result in the release of a striker (or hammer) and the firing of the gun. The actuator 210-*a* and/or the actuator 210-*b* may be activated in response to a trigger break, and an electrical pulse (also referred to as a "signal") may be used to activate the actuators. The actuators illustrated in the fire control system 200 may be configured in a complementary fashion (e.g., one "push" actuator and one "pull" actuator) to enhance gun safety. For example, the actuator 210-*a* may be a "push" actuator configured to move rearward (as shown by arrow 215-*a*) from a default position to an action position in response to an electric signal, and the actuator 210-*b* may be a "pull" actuator configured to move forward (as shown by arrow 215-*b*) from a default position to an action position in response to an electrical signal.

Configuring the actuators in a complementary fashion, as shown in FIG. 2, produces a sear mechanism with enhanced safety, as the first actuator (e.g., the actuator 210-*a*) is largely unaffected by force in a first direction, and the second actuator (e.g., the actuator 210-*b*) is largely unaffected by force in an opposing direction, thereby reducing the likelihood of an unintended discharge, such as when the gun is dropped. The gun may also include mechanical safeties that function in conjunction with actuators to further enhance the safety of the gun.

The sear 205 may retain a striker, a hammer, a firing pin, or a linkage component while in the default position, and the sear 205 may release the striker, the hammer, the firing pin, or the linkage component based on moving from the default position to the action position. The sear 205, the actuator 210-*a*, and/or the actuator 210-*b* may move from a default position to an action position based on a trigger break. In some examples, the sear 205 may be coupled with, or include aspects of, one or more sear linkages. A sear linkage may extend from a proximal end (e.g., an end contacting a striker, a hammer, a firing pin, or the like) to a distal end (e.g., an end contacting one or more actuators). In other words, the sear 205 may be a single component, or the sear 205 may include multiple components.

One or more force multipliers may be used in the fire control system 200. The spring 220 is an example of a force multiplier, and the length of the sear 205 (and associated leverage) is another example of a force multiplier. The spring 220 may apply force to the sear 205, while the length of the sear 205 may produce leverage such that the force applied at the proximal end of the sear 205 is greater than the force applied at the distal end of the sear 205. The spring 220 may apply force in a direction that is perpendicular to the direction of movement of the actuator 210-*a* and the direction of movement of the actuator 210-*b*. For example, both the actuator 210-*a* and the actuator 210-*b* may move along a longitudinal axis, such as a longitudinal axis that is parallel to a lengthwise axis of a barrel of the gun, and the spring 220 may apply force to the sear 205 along a transverse axis that is perpendicular to the longitudinal axis. For example, the transverse axis may be parallel to a lengthwise axis of a magazine well.

The spring 220 may store energy harvested during slide recoil or slide racking, and the spring 220 may use this energy to apply force to the sear 205. The sear 205 may move from the default position to the action position based on the force applied by the spring 220. For example, the sear 205 may move to the action position based on the force applied by the spring 220, the actuator 210-*a* moving to an action position, and the actuator 210-*b* moving to an action position.

In some examples, the actuators may be located at a distal end of the sear 205, and the length of the sear 205 may be associated with a desired amount leverage (e.g., mechanical advantage). For example, the sear 205 may be configured to move about a fulcrum located at the proximal end of the sear 205, and the actuators may be located at the distal end of the sear 205 to take advantage of the leverage associated with the distance to fulcrum. In some examples, the spring 220 may be located a distance from the fulcrum and the actuators may be located a further distance from the fulcrum, where the different between the distance between the spring 220 and the fulcrum as compared to the distance between the between the actuators and the fulcrum corresponds to a desired about of leverage. In some examples, the sear 205 may satisfy a ratio threshold. For example, the distance between the actuators and the fulcrum as compared to the distance between a sear catch and the fulcrum may satisfy a ratio threshold of 2:1, 25:1, or anywhere in between. In some examples, the length of the sear 205 may satisfy a threshold distance, and the threshold distance may be based on a spring constant value associated with the spring 220, a strength of the actuator 210-*a*, or a strength of the actuator 210-*b*. The length of the sear 205 (e.g., as measured along the longitudinal axis) may satisfy a threshold distance of 10 millimeters (mm), 100 mm, or anywhere in between. Using one or more force multipliers, such as the spring 220 and the leverage associated with the length of the sear 205, reduces the frictional load experienced by the actuators, thereby supporting the use of compact and low power actuators.

An electric pulse transmission technique may be used to activate one or more actuators and fire the gun. For example, when the gun uses one actuator to retain the sear (as shown in the fire control system 302 described with reference to FIG. 3), a signal (e.g., an electric pulse) may be transmitted from a first component (e.g., a capacity bank) to a second component (e.g., a solenoid, a piezoelectric element, etc.) to cause displacement of the actuator (or component thereof, such as a block, a rod, a hook, etc.). Transmitting the signal may result in the release of the striker or hammer and the firing of the gun.

Another electric pulse transmission technique may be used to activate multiple actuators and fire the gun. For example, when the gun uses two actuators to retain the sear (as shown in the fire control system 301 described with reference to FIG. 3), a first signal (e.g., a first electric pulse) may be transmitted to a first component (e.g., a first solenoid, a first piezoelectric element, etc.) associated with a first actuator to cause displacement of the first actuator, and a second signal (e.g., a second electric pulse) may be transmitted to a second component (e.g., a second solenoid, a second piezoelectric element, etc.) associated with a second actuator to cause displacement of the second actuator. A signal may include electric charge discharged from one or more capacitors. Transmitting the first signal and the second signal may result in the release of the striker or hammer and the firing of the gun. For example, the first signal may direct electric current to a first solenoid corresponding to the first actuator to create a first magnetic field, which may result in displacement of the first actuator, and the second signal may direct electric current to a second solenoid corresponding to the second actuator to create a second magnetic field, which may result in displacement of the second actuator. The gun may fire as a result of activating both actuators. Activating an actuator may include transmitting a signal to the actuator such that the actuator (or an actuator component, such as a plunger block) is displaced.

The actuators (e.g., the actuator 210-*a* and the actuator 210-*b*) may be activated simultaneously, or the actuators may be activated in rapid succession. For example, electric current may be directed to two actuators simultaneously such that the two actuators activate at the same time. In another example, electric current may be directed to a first actuator (e.g., actuator 210-*a*), and electric current may be successively directed to a second actuator (e.g., actuator 210-*b*), causing the first actuator and the second actuator to activate in rapid succession. The first actuator and the second actuator may be activated successively such that both the first actuator and the second actuator simultaneously satisfy a displacement threshold. In other words, the first actuator may receive a signal and assume an action position in response to receiving the signal, and the second actuator may receive a signal and assume an action position in response to receiving the signal while the first actuator is still in the activate position, thereby allowing the sear 205 to assume the action position and release the striker or hammer. Activating the actuators in succession draws less power than activating the actuators simultaneously, thereby supporting the use of compact electric components (e.g., actuators, battery packs, capacitors, conductive paths, etc.).

The signal transmission duration, amperage, voltage, or sequencing may be configured based on various characteristics of the gun. As an illustrative example, a handgun may include small electric components that generate low power, and the handgun may transmit signals to actuators successively, while a rifle or shotgun may include larger electric components that generate more power, and the rifle may transmit signals to actuators simultaneously. In some examples, a gun may include an actuator return damper to slow or control the speed at which an actuator (or an actuator component, such as a plunger block) returns to a default position from an action position. Using such a damper improves successive signal transmission techniques, thereby supporting lower signal power and reducing the size of electric components, such as capacitors, batteries, solenoids, or actuators. Reducing the size of electric components facilitates improved gun design by reducing the amount of space taken up by the electric components.

Figure 3:
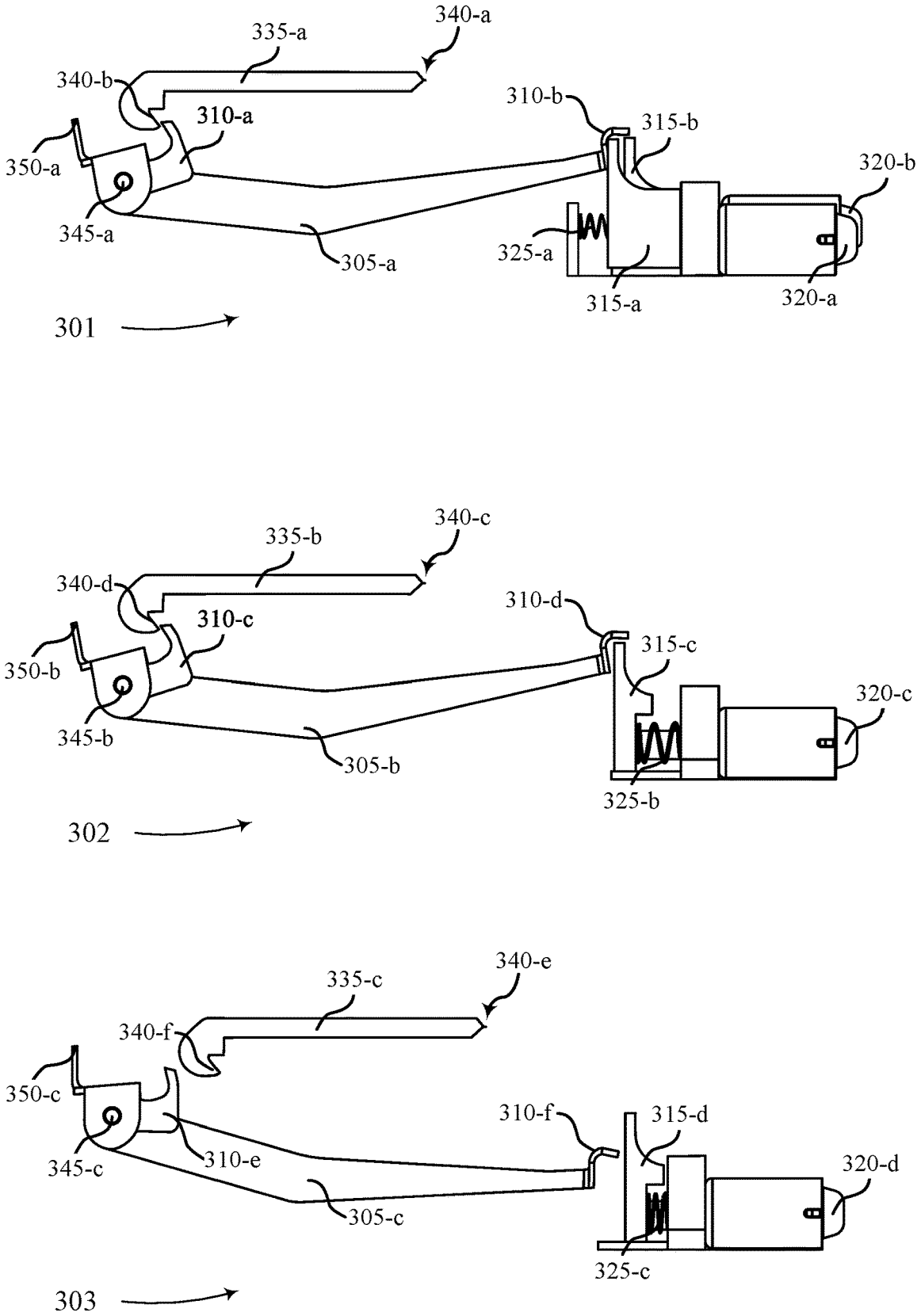
FIG. 3 illustrates examples of fire control systems that support an electromechanical sear in accordance with aspects of the present disclosure.

FIG. 3 illustrates an example of a fire control system 301, an example of a fire control system 302, and an example of a fire control system 303 that support an electromechanical sear in accordance with aspects of the present disclosure. The fire control system 301, the fire control system 302, and the fire control system 303 may be aspects of the gun 100 as described with the reference to FIG. 1. The fire control system 301 includes two actuators in a default position, the fire control system 302 includes one actuator in a default position, and the fire control system 303 includes one actuator in an action position. As described herein, a fire control system may include one or more actuators for managing a sear.

An actuator may be used to manage a sear by retaining or obstructing the sear while in a default position (e.g., a first position) and by releasing or allowing movement of the sear while in an action position (e.g., a second position). The default position prevents the sear from moving, and the action position allows the sear to move such that a striker or hammer is released, causing a firing pin to strike a cartridge primer, ignite propellant, and discharge a projectile from the gun.

The fire control system 301 includes a sear 305-*a* with a catch 310-*a* and a bar 310-*b*, an actuator 315-*a* with a solenoid 320-*a*, an actuator 315-*b* with a solenoid 320-*b*, a spring 325-*a*, and a striker 335-*a* with a firing pin 340-*a* and a bent 340-*b*. The fire control system 301 illustrates the actuator 315-*a*, the actuator 315-*b*, and the sear 305-*a* in default positions.

A signal may be transmitted to the solenoid 320-*a* to activate the actuator 315-*a*, and another signal may be transmitted to the solenoid 320-*b* to activate the actuator 315-*b*. In response to activating the actuators, the bar 310-*b* may drop, moving the sear 305-*a* into an action position and allowing the catch 310-*a* to release the striker 335-*a*. For example, the catch 310-*a* may retain the bent 340-*b* of the striker 335-*a* while in the default position, and the catch 310-*a* may release the bent 340-*b* of the striker 335-*a* based on the sear 305-*a* moving into the action position.

The spring 325-*a* may apply force to the actuator 315-*a* such that the actuator 315-*a* assumes the default position. In other words, the actuator 315-*a* may move from a default position to an action position based on the strength or direction of the magnetic field generated by transmitting a signal to the solenoid 320-*a*, and the spring 325-*a* may apply force to the actuator 315-*a* such that the actuator 315-*a* returns to the default position following the transmission of the signal. The actuator 315-*b* may be associated with a similar spring (not shown) that returns the actuator 315-*b* to the default position.

The end of the sear 305-*a* that includes the catch 310-*a* may be considered the proximal end, and the end of the sear 305-*a* that includes the bar 310-*b* may be considered the distal end. The proximal end of the sear 305-*a* may include a fulcrum 345-*a*, such as a pivot or a hinge, that the catch 310-*a* is configured to rotate about. In some examples, the proximal end of the sear 305-*a* may also include a spring (not shown in FIG. 3) to facilitate movement of the catch 310-*a* about the fulcrum 345-*a*. The catch 310-*a* may retain the striker 335-*a* based on the actuator 315-*a* and the actuator 315-*b* obstructing the bar 310-*b*, and the catch 310-*a* may release the striker 335-*a* in response to activating the actuator 315-*a* and activating the actuator 315-*b*.

The use of complimentary actuators, as illustrated in the fire control system 301, improves gun safety by reducing the likelihood of accidental discharges. Complimentary actuators may be different types of actuators and/or configured to move in different directions. For example, the actuator 315-*a* may be a "push" actuator configured to move in a positive direction along a longitudinal axis, and the actuator 315-*b* may be a "pull" actuator configured to move in a negative direction along the longitudinal axis. The actuators described herein may be examples of solenoid actuators, piezoelectric actuators, pneumatic actuators, electric actuators, or the like.

The sear 305-*a* may be reset into a default position as part of slide recoil or racking. For example, the slide (or a component thereof) may contact the reset tab 350-*a* as the slide moves reward during recoil or racking, load a force multiplier (e.g., by stretching a force multiplying spring), and position the sear 305-*a* in the default position. Energy from the slide recoil or racking may be stored by the force multiplier and applied to the sear 305-*a*, thereby supporting a crisp and reliable separation between the sear 305-*a* (e.g., the catch 310-*a*) and the striker 335-*a* (e.g., the bent 340-*b*).

The fire control system 302 includes a sear 305-*b* with a catch 310-*c* and a bar 310-*d*, an actuator 315-*c* with a solenoid 320-*c*, a spring 325-*b*, and a striker 335-*b* with a firing pin 340-*c* and a bent 340-*d*. The fire control system 302 illustrates the actuator 315-*c* in a default position and the sear 305-*b* in a default position.

The catch 310-*c* may rotate about the fulcrum 345-*b* based on the actuator 315-*c* moving into an action position and the bar 310-*d* dropping. As a result of the actuator 315-*c* moving and the bar 310-*d* dropping, the catch 310-*c* may rotate about the fulcrum 345-*b*, causing the release of the striker 335-*b* and the firing of the gun. The sear 305-*b* may be reset based on the reset tab 350-*b*. For example, as part of slide recoil or racking, the slide (or component thereof) may contact the reset tab 350-*b*, raise the sear 305-*b* to a default position, and facilitate or allow the spring 325-*b* to move the actuator 315-*c* into the default position.

The fire control system 303 includes a sear 305-*c* with a catch 310-*e* and a bar 310-*f*, an actuator 315-*d* with a solenoid 320-*d*, a spring 325-*c*, and a striker 335-*c* with a firing pin 340-*e* and a bent 340-*f* The fire control system 303 illustrates the actuator 315-*d* in an action position and the sear 305-*c* in an action position.

The catch 310-*e* may rotate about the fulcrum 345-*c* based on the actuator 315-*d* assuming an action position and the bar 310-*f* dropping. As a result of the actuator 315-*d* moving and the bar 310-*f* dropping, the catch 310-*e* may rotate about the fulcrum 345-*c*, causing the release of the striker 335-*c* and the firing of the gun. The sear 305-*c* may be reset based on the reset tab 350-*c*. For example, as part of slide recoil or racking, the slide (or component thereof) may contact the reset tab 350-*c*, raise the sear 305-*c* to a default position, and facilitate or allow the spring 325-*c* to move the actuator 315-*d* into the default position.

The fire control system 303 illustrates an actuator in an action position and a sear in an action position. The actuator 315-*d* in the fire control system 303 may assume the action position in response to activating the actuator 315-*d* (e.g., transmitting a signal to the actuator 315-*d*), and the sear 305-*c* may assume the action position in response to activating the actuator 315-*d*. The fire control system 302 illustrates an actuator in a default position and a sear in a default position. The actuator 315-*c* in the fire control system 302 may assume the default position based on the spring 325-*b* and/or the lack of electric current activating the actuator 315-*c*, and the sear 305-*b* may assume the default position in response to the slide contacting the reset tab 350-*b*. The fire control system 301 illustrates the sear 305-*a*, the actuator 315-*a*, and the actuator 315-*b* in default positions, but it should be understood that the actuator 315-*a* may assume an action position in response to transmitting a signal to the actuator 315-*a*, the actuator 315-*b* may assume an action position in response to transmitting a signal to the actuator 315-*b*, and the sear 305-*a* may assume an action position based on the actuator 315-*a* assuming the action position and the actuator 315-*b* assuming the action position.

The firing systems described herein may include both mechanical safety features and electrical safety features to improve gun safety. A firing system may include a trigger safety that retains the trigger in a default position (e.g., prevents accidental trigger engagement) until a trigger lever is engaged, thereby preventing trigger displacement resulting from lateral forces applied to the trigger. The gun may include a striker safety that blocks the striker until the trigger is pulled, and the gun may include a drop safety that prevents the sear from releasing the striker until the trigger is pulled. The trigger bar may include a tab that is located under the sear while the trigger is in the default position to retain the sear, and as the trigger is pulled, the trigger bar tab moves out from under the sear to allow displacement of the sear and release of the striker. One or more electrical actuators may be used in addition to the mechanical safeties to prevent accidental discharge of the gun. Using both mechanical and electrical safety components improves the overall safety of the gun, as disparate and redundant safety mechanisms are unlikely to become compromised.

Figure 4:
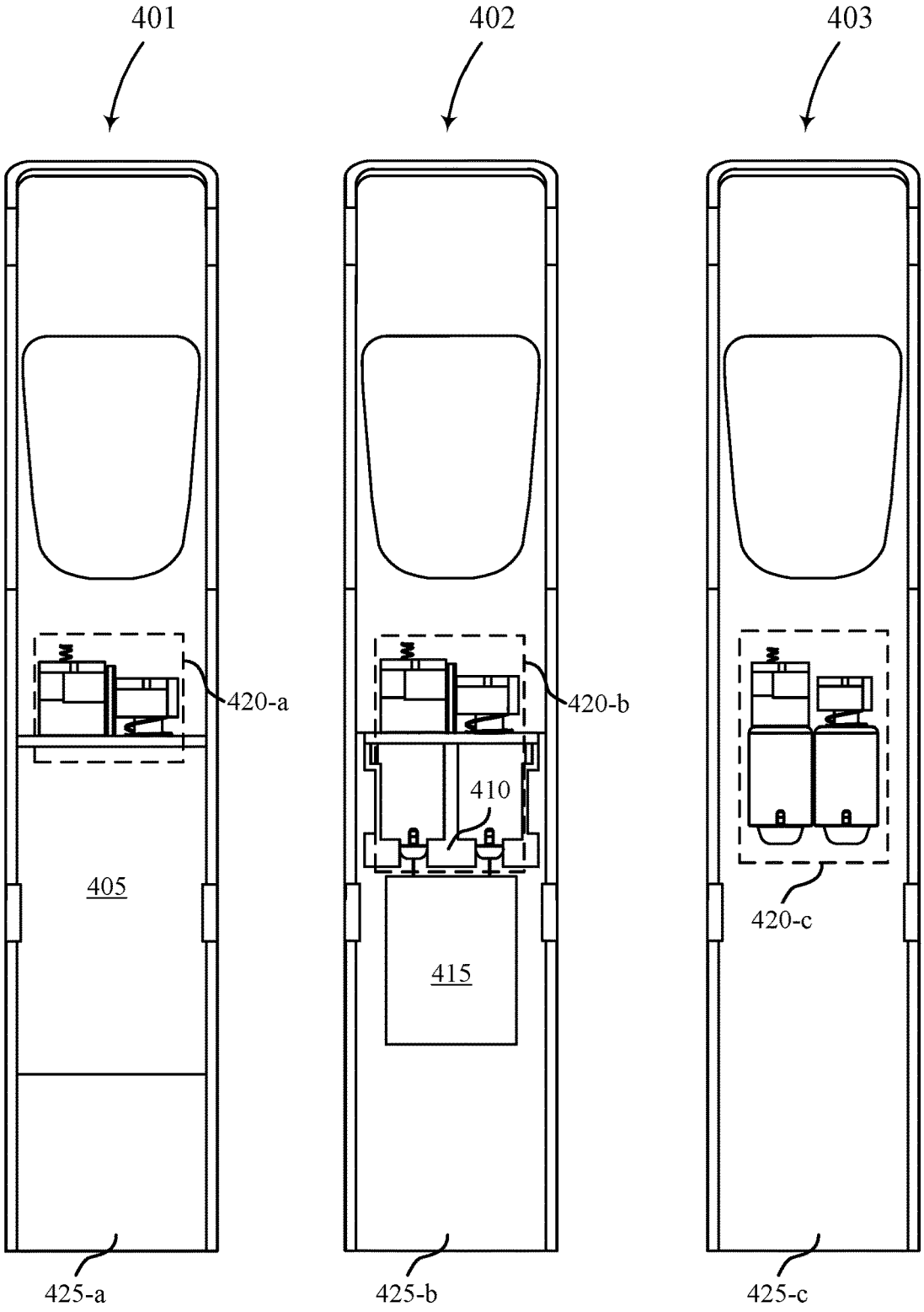
FIG. 4 illustrates an example of actuator packaging that supports an electromechanical sear in accordance with aspects of the present disclosure.

FIG. 4 illustrates an example of actuator packaging that supports an electromechanical sear in accordance with aspects of the present disclosure. FIG. 4 illustrates an example of a potting configuration 401, an example of a housing configuration 402, and an example of an actuator configuration 403 that support an electromechanical sear in accordance with aspects of the present disclosure.

A gun may include a chassis (e.g., also referred to as a "frame"), and FIG. 4 illustrates a chassis with an actuator system at different stages of packaging. For example, the actuator configuration 403 illustrates actuators 420-*c* contacting an interior surface of the chassis 425-*c*, the housing configuration 402 illustrates actuators 420-*b* in an actuator housing 410, and the potting configuration 401 illustrates actuators 420-*a* embedded in a potting compound 405. The actuators 420-*a*, the actuators 420-*b*, and the actuators 420-*c* may represent a pair of actuators at different stages of packaging, but it should be understood that additional or fewer actuators may be used. The chassis 425-*a*, the chassis 425-*b*, and the chassis 425-*c* may represent a chassis at different stages of assembly or manufacturing.

The potting configuration 401 includes a potting compound 405 that adheres the actuators 420-*a* to the chassis 425-*a*. The potting compound 405 may block contaminants, mitigate tampering, and ease thermal conditions. For example, the potting compound 405 may be an epoxy-based compound that blocks soot and dirt while inhibiting tampering of the actuators 420-*a*. Additionally, the potting compound may act as a thermal barrier around the actuators 420-*a*, which may improve the reliability and longevity of the actuators 420-*a*. In some examples, the potting compound 405 may be a two-part adhesive, such as Scotch Weld, J-B Weld, Gorilla Weld, Stewart-MacDonald Epoxy, Loctite Epoxy, Stone Coat Epoxy, or the like.

The housing configuration 402 includes actuators 420-*b*, an actuator housing 410, and a fire control manager 415. The actuator housing 410 may be used to manage the positioning of one or more actuators. The actuator housing 410 may be made of metal, allow, polymer, a combination thereof. The fire control manager 415 may implement logic via analog electrical components and/or digital electrical components. In some examples, the fire control manager 415 may include a memory bank, a capacitor bank, or a processor. Implementing aspects of the fire control manager 415 in analog and/or digital circuits reduces latency between a trigger break and the gun firing, thereby enhancing the perceived accuracy of the gun and improving user experience. In some examples, the actuator housing 410 and/or the fire control manager 415 may be in contact with the chassis 425-*b*. The surface of the chassis 425-*b* shown in FIG. 4 may be considered an interior surface of the chassis, while a surface of the chassis 425-*b* not shown in FIG. 4 (e.g., the surface on the under-side of the chassis) may be considered an exterior surface of the chassis.

The housing configuration 402 does not include potting, but it should be understood that the potting compound 405 may be used to adhere components to the chassis 425-*b*. For example, potting may be used to adhere the actuator housing 410, the fire control manger 415, the actuators 420-*b*, or any combination thereof, to the chassis 425-*b*.

The actuator configuration 403 includes actuators 420-*c*. The actuators 420-*c* may be in contact with an interior surface of the chassis 425-*c*. The chassis 425-*c* may be made of metal, alloy, polymer, or a combination thereof. In some examples, the chassis 425-*c* may be comprised of steel, while in other examples, the chassis 425-*c* may be comprised of aluminum. The chassis 425-*c* may be produced though a stamping manufacturing process, a die cast manufacturing process, a machining manufacturing process, or a combination thereof.

Figure 5:
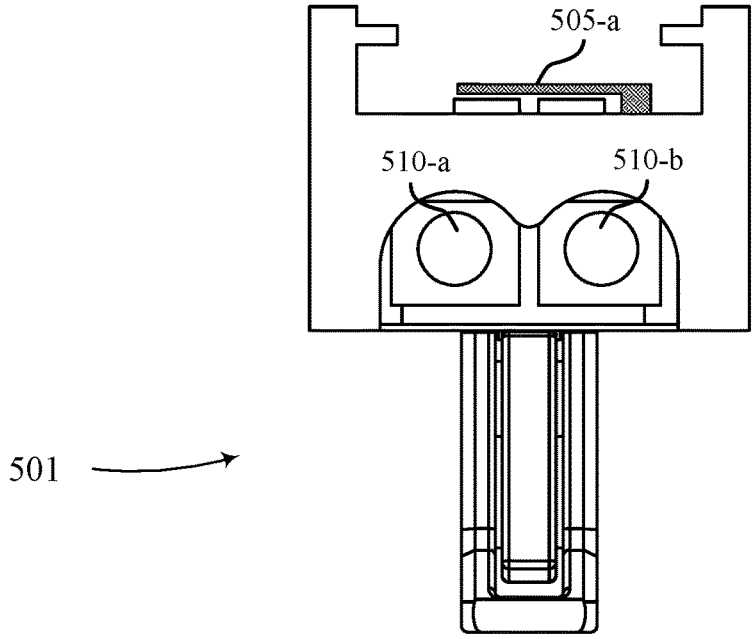
FIG. 5 illustrates examples of gun chassis that support an electromechanical sear in accordance with aspects of the present disclosure.
Figure 5:
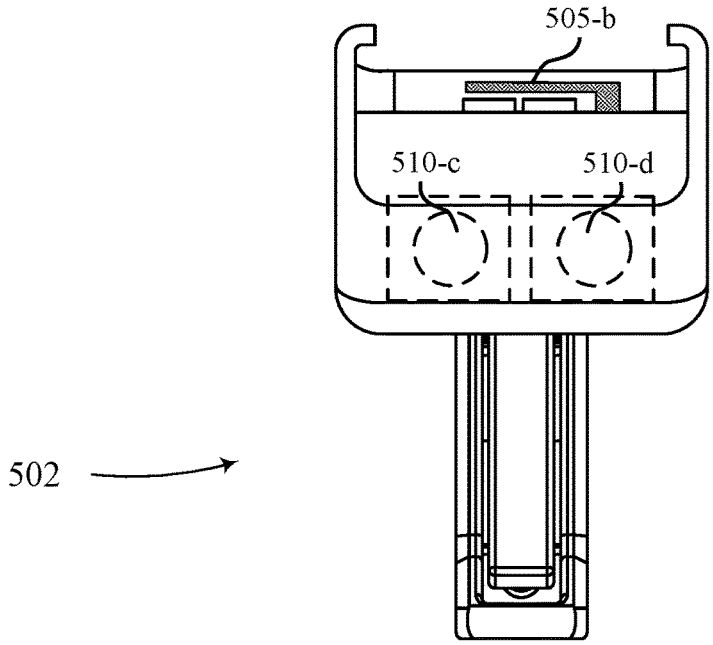

FIG. 5 illustrates an example of a gun chassis 501 and an example of a gun chassis 502 that support an electromechanical sear in accordance with aspects of the present disclosure. A gun may include one or more actuators coupled with an exterior surface of a chassis, as illustrated in the gun chassis 501, or the gun may include one or more actuators coupled with an interior surface of the chassis, as illustrated in the gun chassis 502.

The gun chassis 501 illustrates an example of actuators coupled with an exterior surface of the gun chassis 501. The actuator 510-*a* and the actuator 510-*b* may be coupled with, in contact with, or otherwise proximate to, the exterior surface of the gun chassis 501. The actuator 510-*a* and the actuator 510-*b* may manage the sear 505-*a*. In some examples, the gun chassis 501 may be a machined chassis.

The gun chassis 502 illustrates an example of actuators coupled with an interior surface of the gun chassis 502. The actuator 510-*c* and the actuator 510-*d* may be coupled with, in contact with, or otherwise proximate to, the interior surface of the gun chassis 502. The actuator 510-*c* and the actuator 510-*d* may manage the sear 505-*b*. In some examples, the gun chassis 502 may be a stamped chassis or a die cast chassis.

The gun chassis 501 and/or the gun chassis 502 may comprise a metal alloy, such as steel, aluminum, aluminum-magnesium, or the like. The actuators described with reference to FIG. 5 may be solenoid-based actuators, piezoelectric-based actuators, pneumatic actuators, hydraulic actuators, or the like.

Figure 6:
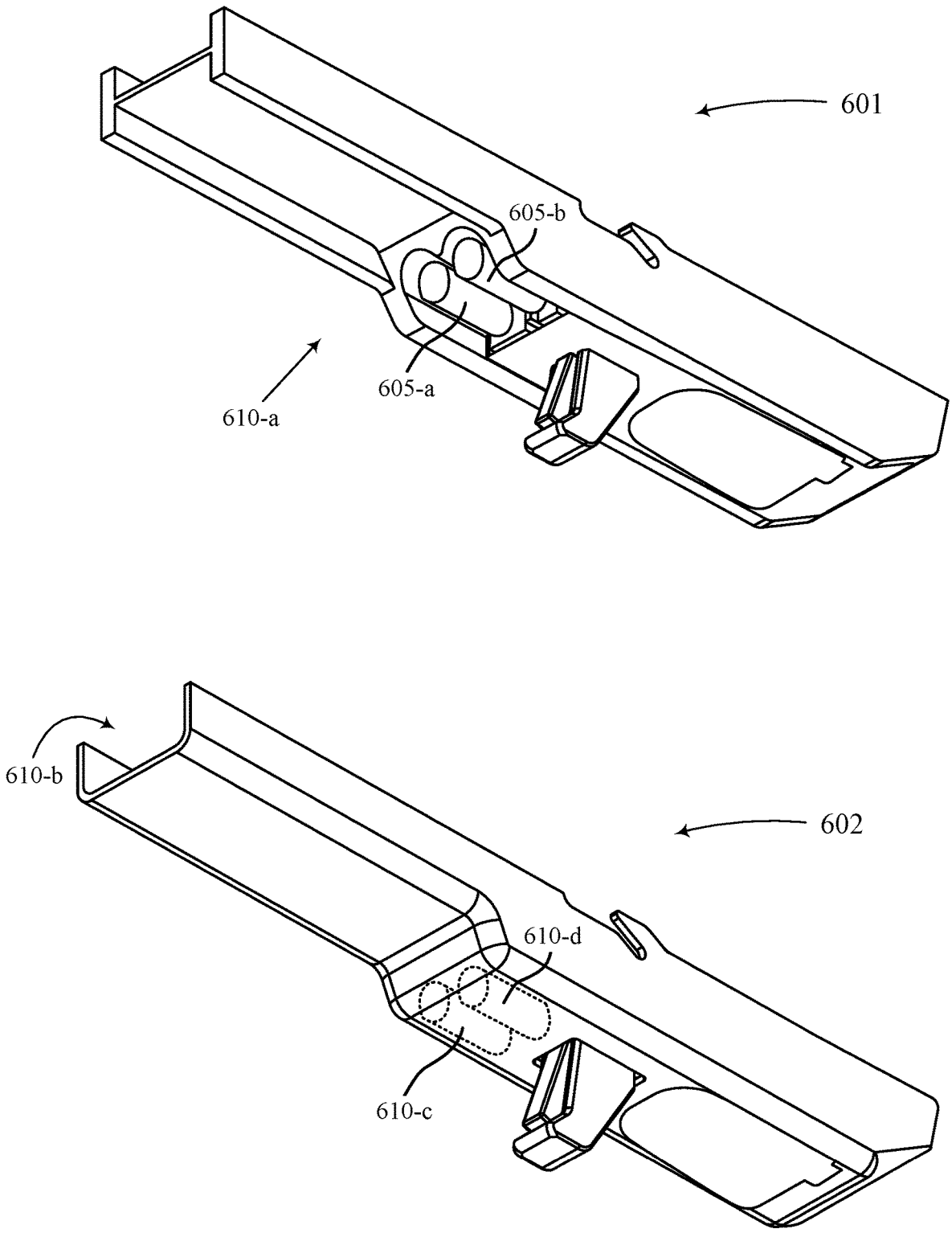
FIG. 6 illustrates examples of gun chassis that support an electromechanical sear in accordance with aspects of the present disclosure.

FIG. 6 illustrates an example of a gun chassis 601 and an example of a gun chassis 602 that support an electromechanical sear in accordance with aspects of the present disclosure. A gun may include one or more actuators coupled with an exterior surface of a chassis, as illustrated in the gun chassis 601, or the gun may include one or more actuators coupled with an interior surface of the chassis, as illustrated in the gun chassis 602.

The gun chassis 601 illustrates an example of actuators coupled with an exterior surface 610-*a* of the gun chassis 601. The actuator 605-*a* and the actuator 605-*b* may be coupled with, in contact with, or otherwise proximate to, the exterior surface 610-*a*. In some cases, the gun chassis 601 may be a machined chassis. In some examples, the gun chassis 601 may be machined steel or aluminum.

The gun chassis 602 illustrates an example of a chassis with actuators coupled with an interior surface 610-*b* of the gun chassis 602. The actuator 610-*c* and the actuator 610-*d* may be coupled with, in contact with, or otherwise proximate to, the interior surface 610-*b*. In some examples, the gun chassis 602 may be a stamped chassis or a die cast chassis.

The gun chassis 601 and/or the gun chassis 602 may comprise a metal alloy, such as steel, aluminum, aluminum-magnesium, or the like. The actuators described with reference to FIG. 6 may be solenoid-based actuators, piezoelectric-based actuators, pneumatic actuators, hydraulic actuators, or the like.

Figure 7:
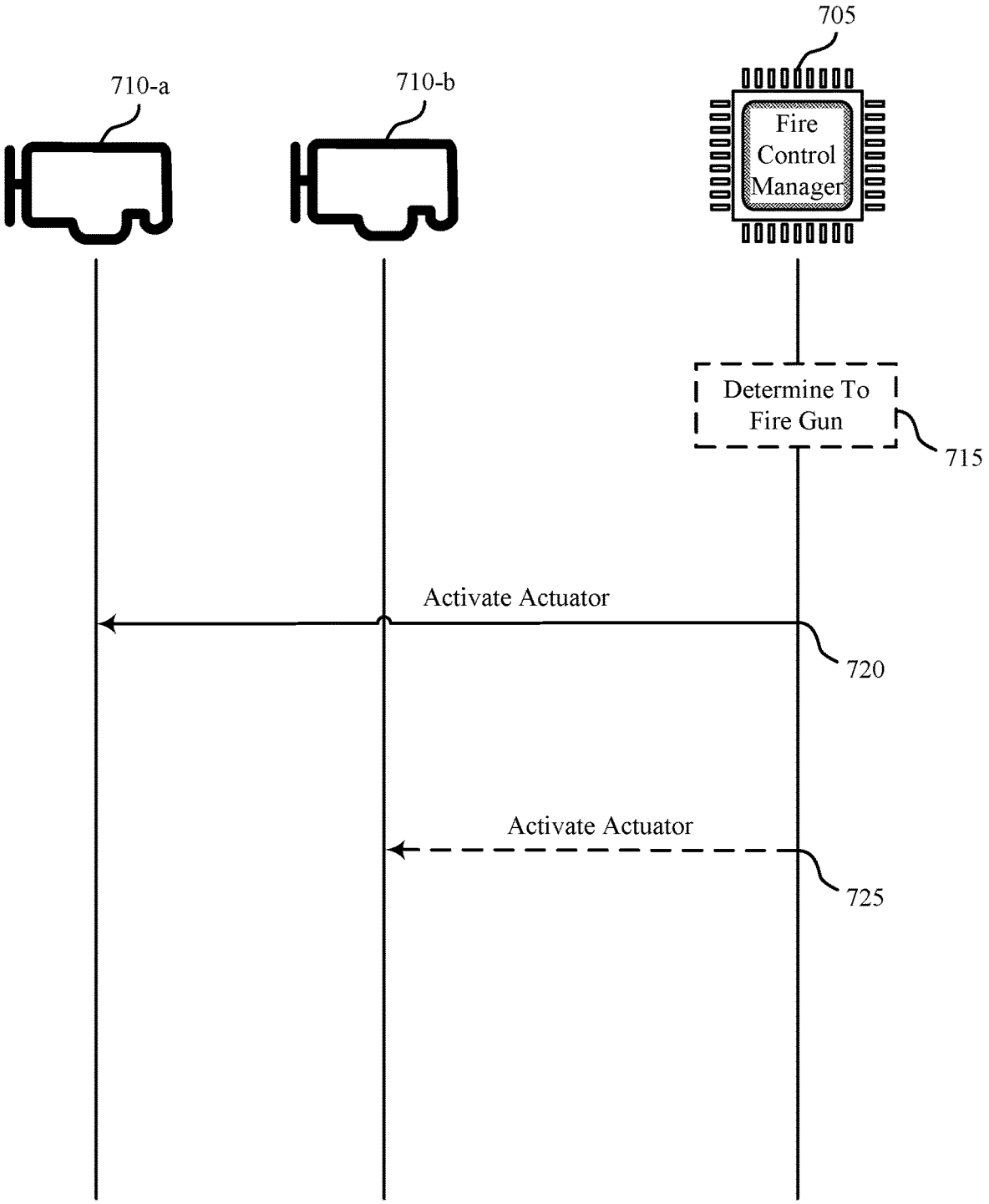
FIG. 7 illustrates an example of a process flow that supports an electromechanical sear in accordance with aspects of the present disclosure.

FIG. 7 illustrates an example of a process flow 700 that supports an electromechanical sear in accordance with aspects of the present disclosure. The process flow 700 includes a fire control manager 705, an actuator 710-*a*, and an actuator 710-*b*, which may be examples of the corresponding components described with reference to FIGS. 1 through 6. The fire control manager 705, the actuator 710-*a*, and/or the actuator 710-*b* may be components of a gun described herein. Alternative examples of the following may be implemented, where some steps are performed in a different order than described or are not performed at all. In some cases, steps may include additional features not mentioned below, or further steps may be added.

The fire control manager 705 may manage a firing system, which may include an electromechanical sear. The fire control manager 705 may implement logic to control the firing of the gun, and the fire control manager 705 may include analog circuits, digital circuits, a processor, or other components that support performing logical functions. In some examples, the fire control manager 705 may include analog and/or digital circuits that allow the gun to be fired in some states, while preventing the gun from being fired in other states. For example, the fire control manager 705 may allow the gun to be fired while in an unlocked state (e.g., a valid user is authenticated, when a valid user is holding the gun, etc.), and the fire control manager 705 may prevent the gun from being fired while in a locked state (e.g., a valid user is not authenticated, a valid user is not holding the gun, etc.). Implementing the fire control manger 705, or aspects thereof, in circuits may improve system reliability and reduce latency.

At step 715, the fire control manager 705 may determine to fire the gun. The fire control manager 705 may determine to fire the gun based on a trigger break, a user presence, a user authentication procedure, or a combination thereof. In some examples, the fire control manager 705 may determine to fire the gun based on a trigger sensor (e.g., a Hall effect sensor) indicating the trigger break. Generally, the fire control manager 705 determines that the gun is to be fired based on an analysis of movement of the trigger. For example, the fire control manager 705 may determine that the trigger has been moved at least a predetermined amount, or the fire control manager 705 may determine that movement of the trigger matches a pattern known to be indicative of a request to fire the gun. A trigger break may be identified based on displacement of a detent or in response to trigger movement satisfying a displacement threshold, a force threshold, or both. In some cases, the displacement threshold and/or the force threshold may be configured by an operator of the gun. For example, the operator may adjust a detent, a spring, or a magnet to configure the force threshold, and the trigger break may be identified based on the trigger movement satisfying the force threshold. Regardless of whether movement is compared against a threshold value or pattern, the fire control manager 705 may be said to be monitoring for, and then identifying, "trigger breaks." Accordingly, the term "trigger break" may refer to a situation where the trigger moves from its default position in such a manner so as to indicate that the gun is to be fired.

At step 720, the fire control manager 705 may activate the actuator 710-*a*. The fire control manager 705 may active the actuator 710-*a* by transmitting an electrical signal (also referred to as a "signal"). The signal may be transmitted to a solenoid, a piezoelectric element, or the like, and transmitting the signal may cause the actuator 710-*a* to activate. For example, electric current may be directed at a solenoid such that an electromagnetic field is generated around the solenoid, and the actuator 710-*a* may activate and displace a component, such as a plunger or block, based on the electromagnetic field. In another example, electric current may be directed at a piezoelectric element of the actuator 710-*a*, and the actuator 710-*a* may activate and displace a component, the component, such as a plunger or block, based on directing the electric current at the piezoelectric element. The actuator 710-*a* may transition from a default state to an action state based on transmitting the signal.

At step 725, the fire control manager 705 may active the actuator 710-*b*. The fire control manager 705 may active the actuator 710-*b* by transmitting a signal to a solenoid, a piezoelectric element, or the like, and transmitting the signal may cause the actuator 710-*b* to activate. Activating the actuator 710-*b* result in the actuator 710-*b* transitioning from a default state to an action state.

The gun may fire a projectile based on the fire control manager 705 activating the actuator 710-*a* and/or activating the actuator 710-*b*. In some examples, the gun may include the actuator 710-*a* and the gun may fire in response to activating the actuator 710-*a*. In some other examples, the gun may include both the actuator 710-*a* and the actuator 710-*b*, and the gun may fire in response to activating both the actuator 710-*a* and the actuator 710-*b*. As an illustrative example, the actuator 710-*a* and the actuator 710-*b* may both retain or obstruct a sear while in the default position, and the actuator 710-*a* and the actuator 710-*b* may release or refrain from obstructing the sear while in an action position such that the sear can release the striker or hammer. As yet another illustrative example, activating the actuator 710-*a* may disengage a safety component (e.g., a drop safety, a firing pin safety, a trigger safety, etc.), activating the actuator 710-*b* may facilitate the sear releasing the striker or hammer, and the gun may fire a projectile in response to activating both the actuator 710-*a* and the actuator 710-*b*.

Figure 8:
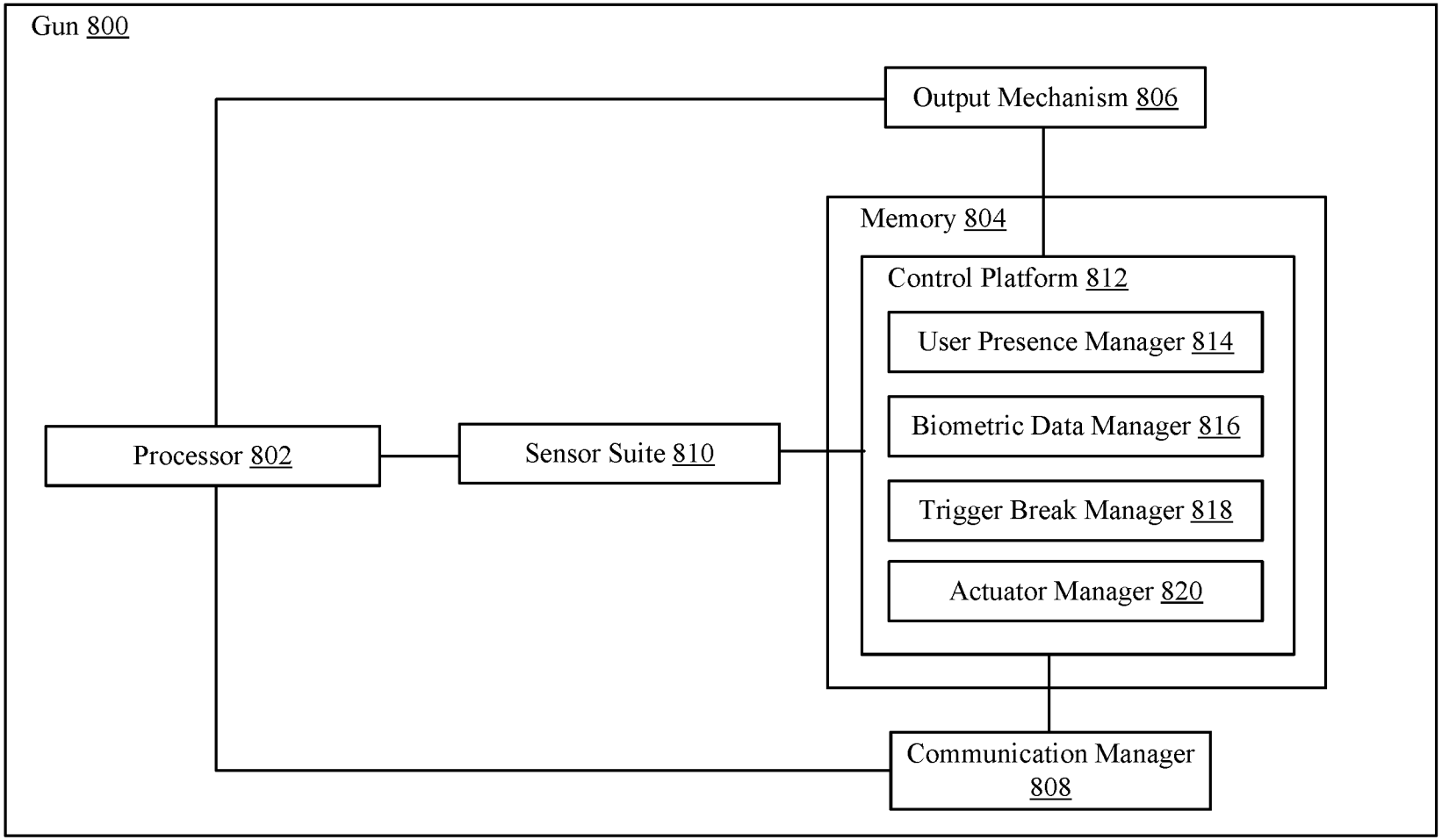
FIG. 8 illustrates an example of a gun that supports an electromechanical sear in accordance with aspects of the present disclosure.

FIG. 8 illustrates an example of a gun 800 able to implement a control platform 812 designed to produce outputs that are helpful in ensuring the gun 800 is used in an appropriate manner. As further discussed below, the control platform 812 (also referred to as a "management platform" or a "fire control manager") may be designed to identify user presence at the gun 800, receive biometric data from a user, authenticate the user based on the biometric data, fire the gun 800, or transition the gun 800 into a state, such as an unlocked state and a locked state. Because the control platform 812 may be responsible for managing the firing of the gun 800, the control platform 812 may also be referred to as a "controller."

In some embodiments, the control platform 812 is embodied as a computer program that is executed by the gun 800. In other embodiments, the control platform 812 is embodied as an electrical circuit that performs logical operations of the gun 800. In yet other embodiments, the control platform 812 is embodied as a computer program that is executed by a computing device to which the gun 800 is communicatively connected. In such embodiments, the gun 800 may transmit relevant information to the computing device for processing as further discussed below. Those skilled in the art will recognize that aspects of the computer program could also be distributed amongst the gun 800 and computing device.

The gun 800 can include a processor 802, memory 804, output mechanism 806, and communication manager 808. The processor 802 can have generic characteristics similar to general-purpose processors, or the processor 802 may be an application-specific integrated circuit (ASIC) that provides control functions to the gun 800. As illustrated in FIG. 8, the processor 802 can be coupled, directly or indirectly, with components of the gun for communication purposes.

The memory 804 may be comprised of any suitable type of storage medium, such as static random-access memory (SRAM), dynamic random-access memory (DRAM), electrically erasable programmable read-only memory (EEPROM), flash memory, or registers. In addition to storing instructions that can be executed by the processor 802, the memory 804 can also store data generated by the processor 802 (e.g., when executing the managers of the control platform 812). Note that the memory 804 is merely an abstract representation of a storage environment. The memory 804 could be comprised of actual memory chips or managers.

The output mechanism 806 can be any component that is capable of conveying information to a user of the gun 800. For example, the output mechanism 806 may be a display panel (or simply "display") that includes LEDs, organic LEDs, liquid crystal elements, or electrophoretic elements. Alternatively, the display may simply be a series of illuminants (e.g., LEDs) that are able to indicate the status of the gun 800. Thus, the display may indicate whether the gun 800 is presently in a locked state, unlocked state, a charging state, etc. As another example, the output mechanism 806 may be a loudspeaker (or simply "speaker") that is able to audibly convey information to the user.

The communication manager 808 may be responsible for managing communications between the components of the gun 800. Additionally or alternatively, the communication manager 808 may be responsible for managing communications with computing devices that are external to the gun 800. Examples of computing devices include docking stations, mobile phones, tablet computers, wearable electronic devices (e.g., fitness trackers), and network-accessible server systems comprised of computer server(s). Accordingly, the communication manager 808 may be wireless communication circuitry that is able to establish communication channels with computing devices. Examples of wireless communication circuitry include integrated circuits (also referred to as "chips") configured for Bluetooth®, Wi-Fi®, Near Field Communication (NFC), and the like.

Sensors are normally implemented in the gun 800. Collectively, these sensors may be referred to as the "sensor suite" 810 of the gun 800. For example, the gun 800 may include a motion sensor whose output is indicative of motion of the gun 800 as a whole. Examples of motion sensors include multi-axis accelerometers and gyroscopes. As another example, the gun 800 may include a proximity sensor (e.g., a photoelectric sensor, a capacitive sensor, an inductive sensor, etc.) whose output is indicative of proximity of the gun 800 to a nearest obstruction within the field of view of the proximity sensor. A proximity sensor may include, for example, an emitter that is able to emit infrared (IR) light and a detector that is able to detect reflected IR light that is returned toward the proximity sensor. These types of proximity sensors are sometimes called laser imaging, detection, and ranging (LiDAR) scanners. As another example, the gun 800 may include a fingerprint sensor or image sensor that generates images which can be used for, for example, biometric authentication. As yet another example, the gun 800 may include a trigger sensor, such as a Hall effect sensor, a photoelectric sensor, a mechanical switch, or the like. As shown in FIG. 8, outputs produced by the sensor suite 810 may be provided to the control platform 812 for examination or analysis.

For convenience, the control platform 812 may be referred to as a computer program that resides in the memory 804. However, the control platform 812 could be comprised of software, firmware, or hardware components that are implemented in, or accessible to, the gun 800. In accordance with embodiments described herein, the control platform 812 may include a user presence manager 814, a biometric data manager 816, a trigger break manager 818, and an actuator manager 820. As an illustrative example, the user presence manager 814 may process data generated by, and obtained from, a photoelectric proximity sensor, the biometric data manager 816 may process data generated by, and obtained from, a fingerprint scanner, the trigger break manager 818 may process data generated by, and obtained from, a trigger sensor (e.g., A Hall effect sensor, a photoelectric sensor, a mechanical switch, etc.), and the actuator manager 820 may transmit signals to an actuator to control the movement of the actuator. Because the data obtained by these managers may have different formats, structures, and content, the instructions executed by these managers can (and often will) be different. For example, the instructions executed by the biometric data manager 816 to process data generated by a biometric sensor may be different than the instructions generated by the user presence manager 814 to process data generated by a presence sensor, such as a photoelectric sensor, a capacitive sensor, or an inductive sensor. Also, different managers may use different hardware to implement logic or execute instructions. For example, the biometric data manager 816 may use a processor to process the data generated by the biometric sensor, and the trigger break manager 818 may use an analog circuit to process the data generated by the trigger sensor.

Figure 9:
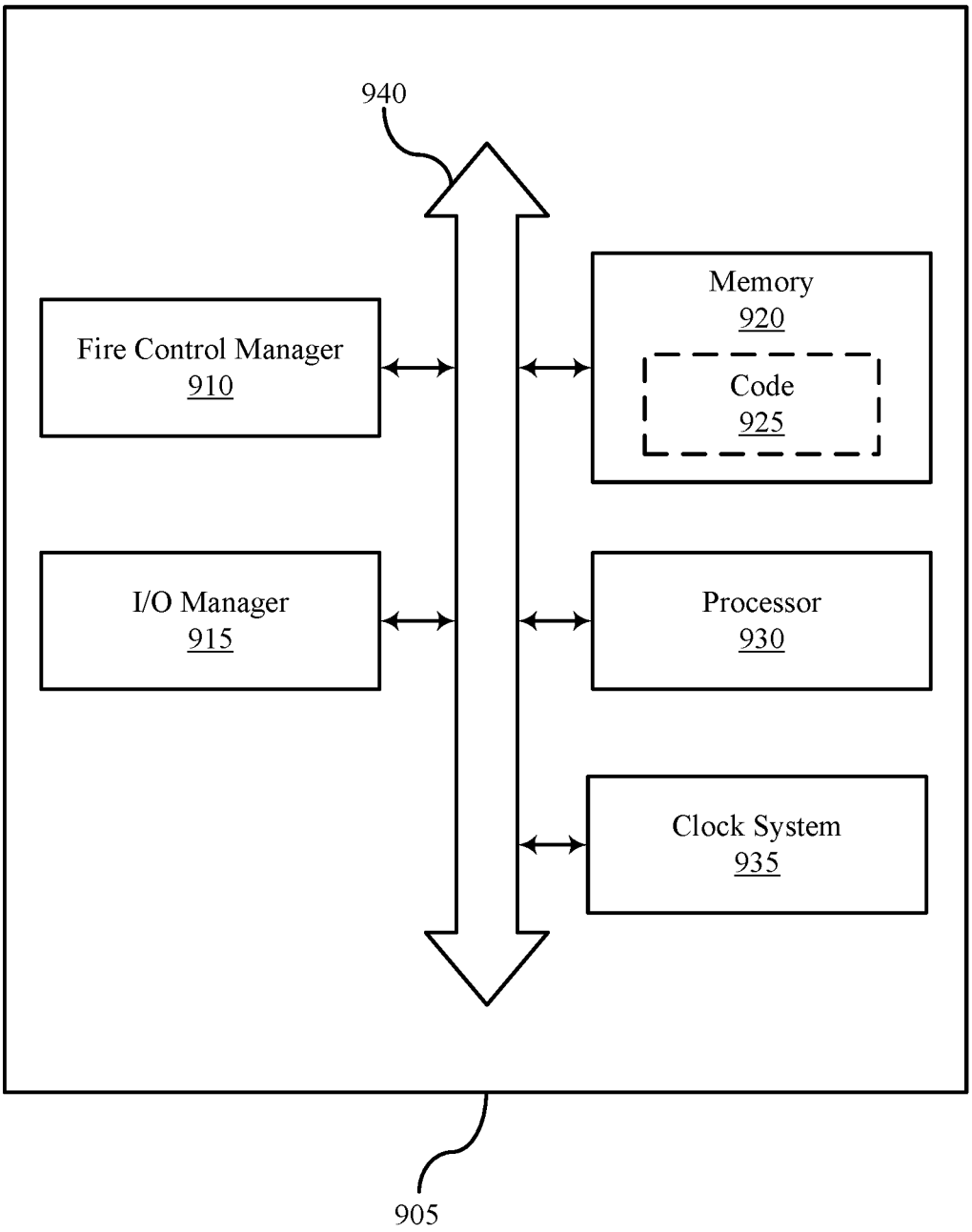
FIG. 9 illustrates an example of a system that supports an electromechanical sear in accordance with aspects of the present disclosure.

FIG. 9 illustrates an example of a system 900 that supports an electromechanical sear in accordance with aspects of the present disclosure. The device 905 may be operable to implement the techniques, technology, or systems disclosed herein. The device 905 may include components such as a fire control manager 910, an I/O manager 915, memory 920, code 925, a processor 930, a clock system 935, and a bus 940. The components of the device 905 may communicate via one or more buses 940. The device 905 may be an example of, or include components of, an electromechanical sear, a firing system, or a gun.

The fire control manager 910 may determine that the device 905 is to be fired based on an analysis of movement of the trigger, transmit, in response to the determining that the device 905 is to be fired, a first signal to a first actuator located in a displacement path of a sear component, so as to cause the first actuator to be displaced in a first direction, and transmit, in response to the determining that the device 905 is to be fired, a second signal to a second actuator located in the displacement path of the sear component, so as to cause the second actuator to be displaced in a second direction different from the first direction. Movement of the sear component may be caused based on (i) the transmitting the first signal to the first actuator and (ii) the transmitting the second signal to the second actuator. The movement of the sear component may result in the release of a striker and the firing of the gun. For example, the movement of the sear component may release a striker including a firing pin, causing the firing pin to strike a cartridge primer, ignite propellent, and propel a projectile through a barrel of the gun.

The fire control manager 910 may transmit a first signal to a first actuator located in a displacement path of a sear component, so as to cause the first actuator to be displaced in a first direction based on the transmitting the first signal, and transmit a second signal to a second actuator located in the displacement path of the sear component, so as to cause the second actuator to be displaced in a second direction based on the transmitting the second signal. Transmitting the first signal to the first actuator and transmitting the second signal to the second actuator may cause the sear component to be displaced. The fire control manager 910 may identify a trigger break based on a trigger sensor, where the transmitting the first signal to the first actuator may be based on the trigger break, and the transmitting the second signal to the second actuator may be based on the trigger break. The transmitting the first signal to the first actuator may include directing electric current to a solenoid coupled with the first actuator to create a magnetic field, where the first actuator is displaced in the first direction based on a strength of the magnetic field. The transmitting the second signal to the second actuator may include directing second electric current to a second solenoid coupled with the second actuator to create a second magnetic field, where the second actuator is displaced in the second direction based on a strength of the second magnetic field.

The I/O manager 915 may manage input and output signals for the device 905. The I/O manager 915 may also manage various peripherals such an input device (e.g., a button, a switch, a touch screen, a dock, a biometric sensor, a pressure sensor, a heat sensor, a proximity sensor, an RFID sensor, etc.) and an output device (e.g., a monitor, a display, an LED, a speaker, a haptic motor, a heat pipe, etc.).

The memory 920 may include or store code 925 (e.g., software). The memory 920 may include volatile memory, such as random-access memory (RAM) and/or non-volatile memory, such as read-only memory (ROM). The code 925 may be computer-readable and computer-executable, and when executed, the code 925 may cause the processor 930 to perform various operations or functions described here.

The processor 930 may be an example or component of a central processing unit (CPU), an application specific integrated circuit (ASIC), or a field programmable gate array (FPGA). In some embodiments, the processor 930 may utilize an operating system or software such as Microsoft Windows®, iOS®, Android®, Linux®, Unix®, or the like. The clock system 935 control a timer for use by the disclosed embodiments.

The fire control manager 910, or its sub-components, may be implemented in hardware, software (e.g., software or firmware) executed by a processor, or a combination thereof. The fire control manager 910, or its sub-components, may be physically located in various positions. For example, in some cases, the fire control manager 910, or its sub-components may be distributed such that portions of functions are implemented at different physical locations by one or more physical components.

Figure 10:
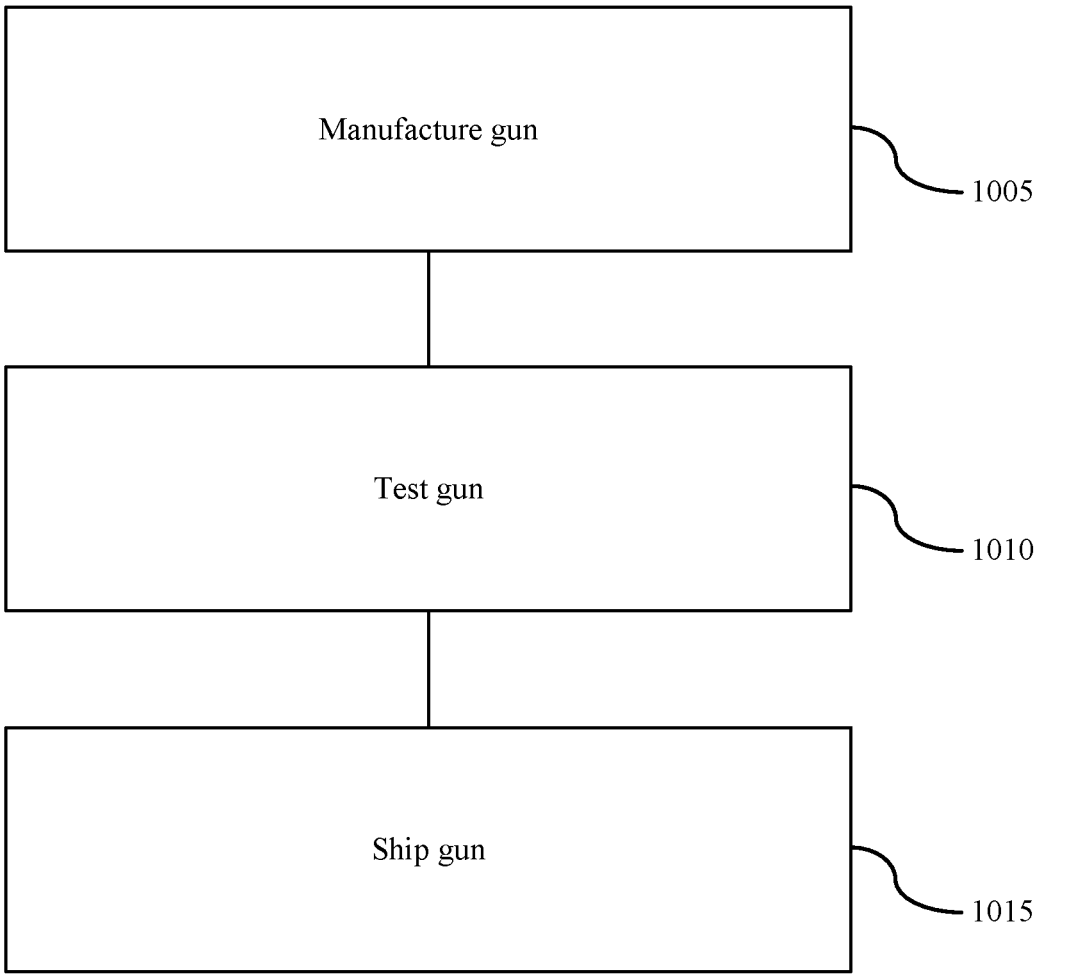
FIG. 10 illustrates an example of a flowchart that supports an electromechanical sear in accordance with aspects of the present disclosure.

FIG. 10 illustrates an example of a flowchart 1000 that shows a process by which a gun that includes an electromechanical sear is manufactured. Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Initially, a gun manufacturer (or simply "manufacturer") may manufacture a gun that is able to implement aspects of the present disclosure (step 1005). For example, the manufacturer may machine, cut, shape, or otherwise make parts to be included in the gun. Thus, the manufacturer may also design those parts before machining occurs, or the manufacturer may verify designs produced by another entity before machining occurs. Additionally or alternatively, the manufacturer may obtain parts that are manufactured by one or more other entities. Thus, the manufacturer may manufacture the gun from components produced entirely by the manufacturer, components produced by other entities, or a combination thereof. For example, the manufacturer may order a batch of sear components (e.g., a sear, a sear linkage, a spring, etc.) from a vendor, and the manufacturer may verify the quality of the sear components as part of step 1010, such as the dimension tolerances of the sear components. Often, the manufacturer will obtain some parts and make other parts that are assembled together to form the gun (or a component of the gun).

In some embodiments, the manufacturer also generates identifying information related to the gun. For example, the manufacturer may etch (e.g., mechanically or chemically), engrave, or otherwise append identifying information onto the gun itself. As another example, the manufacturer may encode at least some identifying information into a data structure that is associated with the gun. For instance, the manufacturer may etch a serial number onto the gun, and the manufacturer may also populate the serial number (and other identifying information) into a data structure for recording or tracking purposes. Examples of identifying information include the make of the gun, the model of the gun, the serial number, the type of projectiles used by the gun, the caliber of those projectiles, the type of firearm, the barrel length, and the like. In some cases, the manufacturer may record a limited amount of identifying information (e.g., only the make, model, and serial number), while in other cases the manufacturer may record a larger amount of identifying information.

The manufacturer may then test the gun (step 1010). In some embodiments, the manufacturer tests all of the guns that are manufactured. In other embodiments, the manufacturer tests a subset of the guns that are manufactured. For example, the manufacturer may randomly or semi-randomly select guns for testing, or the manufacturer may select guns for testing in accordance with a predefined pattern (e.g., once test per 5 guns, 10 guns, or 100 guns). Moreover, the manufacturer may test the gun in its entirety, or the manufacturer may test a subset of its components. For example, the manufacturer may test the component(s) that it manufactures. As another example, the manufacturer may test newly designed components or randomly selected components. Thus, the manufacturer could test select component(s) of the gun, such as the sear and the trigger, or the manufacturer could test the gun as a whole. For example, the manufacturer may test the barrel to verify that it meets a precision threshold and the cartridge feed system to verify that it meets a reliability threshold. As another example, the manufacturer may test a group of guns (e.g., all guns manufactured during an interval of time, guns selected at random over an interval of time, etc.) to ensure that those guns fire at a sufficiently high pressure (e.g., 70,000 pounds per square inch (PSI)) to verify that a safety threshold is met.

Thereafter, the manufacturer may ship the gun to a dealer (step 1015). In the event that the gun is a firearm, the manufacturer may ship the gun to a Federal Firearms Licensed (FFL) dealer. For example, an individual (also referred to as a "user" or "purchaser") may purchase the apparatus through a digital channel or non-digital channel. Examples of digital channels include web browsers, mobile applications, and desktop applications, while examples of non-digital channels include ordering via the telephone and ordering via a physical storefront. In such a scenario, the gun may be shipped to the FFL dealer so that the individual can obtain the gun from the FFL dealer. The FFL dealer may be directly or indirectly associated with the manufacturer of the gun. For example, the FFL dealer may be a representative of the manufacturer, or the FFL dealer may sell and distribute guns on behalf of the manufacturer (and possibly other manufacturers).

Figure 11:
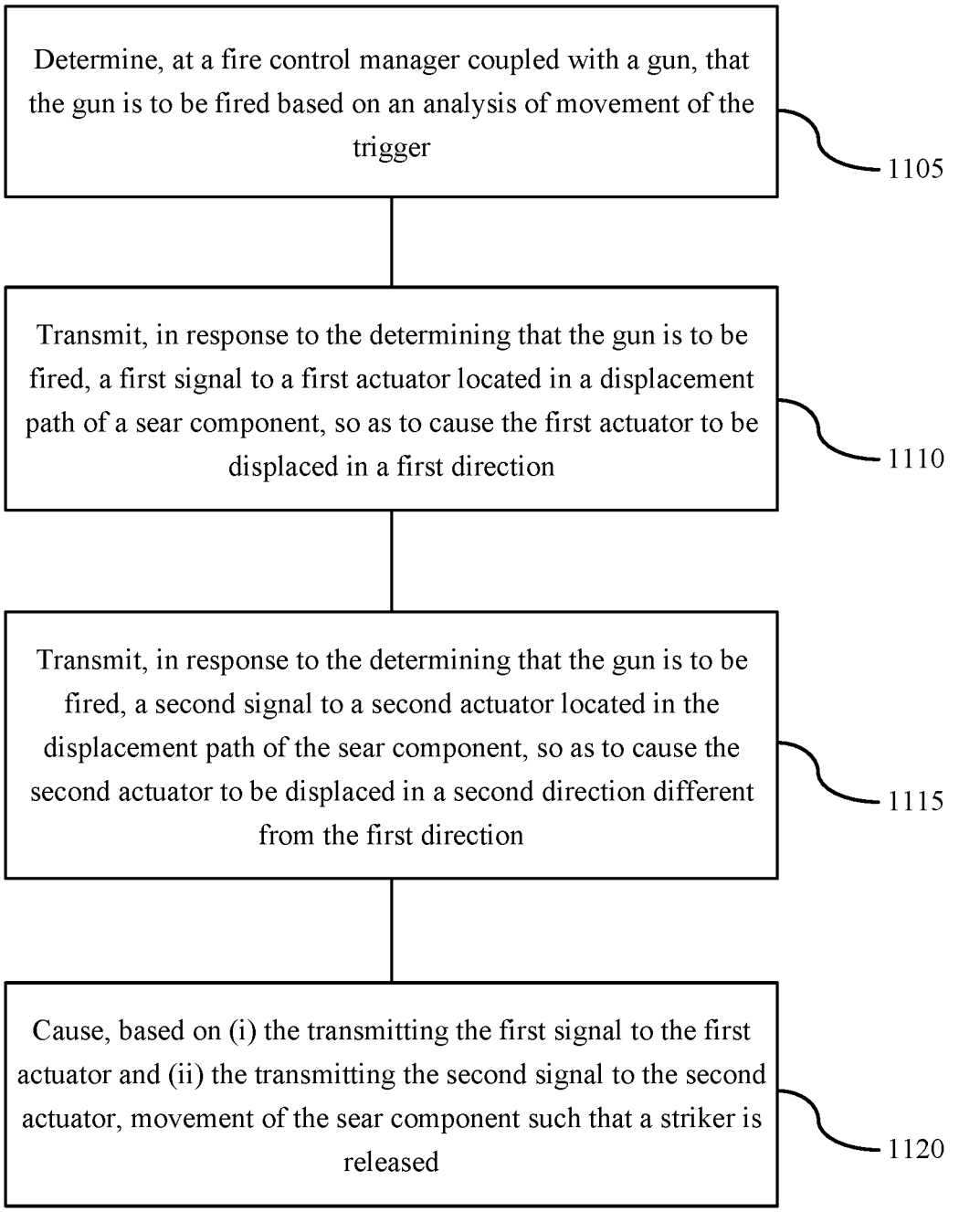
FIG. 11 illustrates an example of a flowchart that supports an electromechanical sear in accordance with aspects of the present disclosure.

FIG. 11 shows a flowchart illustrating a method 1100 of operating a gun that includes an electromechanical sear. The operations of the method 1100 may be implemented by a fire control manager, a gun or its components as described herein. For example, the operations of the method 1100 may be performed by a fire control manager 910 as described with reference to FIG. 9, a control platform 812 as described with reference to FIG. 8, a fire control manager 705 as described with reference to FIG. 7, or a fire control manager 415 as described with reference to FIG. 4. In some examples, a gun may execute a set of instructions to control the functional elements of the gun and to perform the described functions. Additionally or alternatively, the gun may perform aspects of the described functions using special-purpose hardware.

At step 1105, the gun may determine, at a fire control manager coupled with a gun, that the gun is to be fired based on an analysis of movement of the trigger. For example, the fire control manager may determine that the gun is to be fired based on a trigger sensor, such as a Hall effect sensor. The Hall effect sensor may generate a signal indicating a trigger break, and the fire control manager may determine that the gun is to be fired based on the trigger break.

At step 1110, the gun may transmit, in response to the determining that the gun is to be fired, a first signal to a first actuator located in a displacement path of a sear component, so as to cause the first actuator to be displaced in a first direction. In some examples, the first signal may be transmitted to a solenoid or a piezoelectric element, and the first actuator may be activated and transition to an action position based on the first signal.

At step 1115, the gun may transmit, in response to the determining that the gun is to be fired, a second signal to a second actuator located in the displacement path of the sear component, so as to cause the second actuator to be displaced in a second direction different from the first direction. In some examples, the second signal may be transmitted to a solenoid or a piezoelectric element, and the second actuator may be activated and transition to an action position based on the second signal.

At step 1120, the gun may cause, based on (i) the transmitting the first signal to the first actuator and (ii) the transmitting the second signal to the second actuator, movement of the sear component such that a striker, a hammer, or a firing pin is released.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Figure 12:
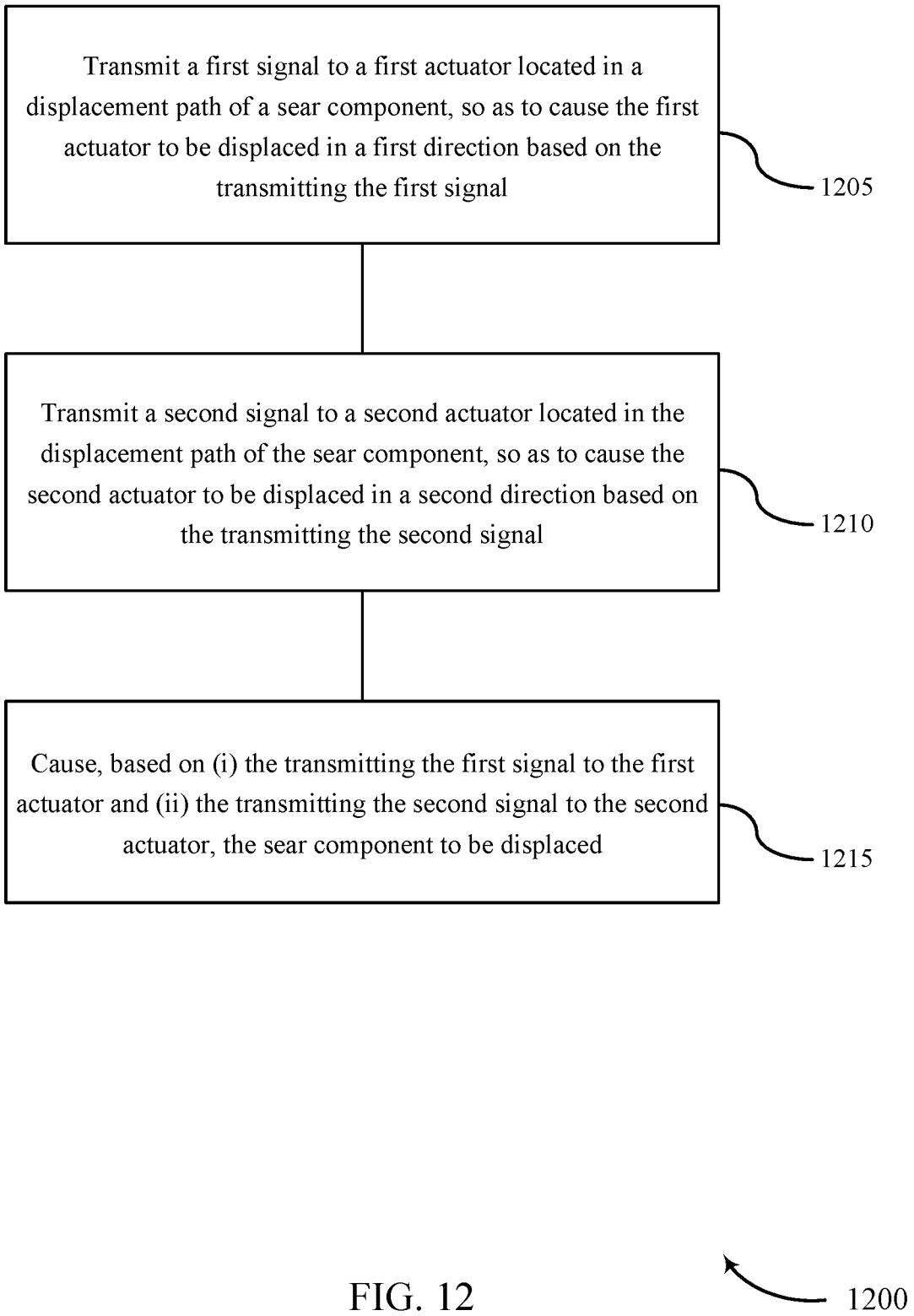
FIG. 12 illustrates an example of a flowchart that supports an electromechanical sear in accordance with aspects of the present disclosure.

FIG. 12 shows a flowchart illustrating a method 1200 of operating a gun that includes an electromechanical sear. The operations of the method 1200 may be implemented by a fire control manager, a gun or its components as described herein. For example, the operations of the method 1200 may be performed by a fire control manager 910 as described with reference to FIG. 9, a control platform 812 as described with reference to FIG. 8, a fire control manager 705 as described with reference to FIG. 7, or a fire control manager 415 as described with reference to FIG. 4. In some examples, a gun may execute a set of instructions to control the functional elements of the gun and to perform the described functions. Additionally or alternatively, the gun may perform aspects of the described functions using special-purpose hardware.

At step 1205, the gun may transmit a first signal to a first actuator located in a displacement path of a sear component, so as to cause the first actuator to be displaced in a first direction based on the transmitting the first signal. In some examples, the first signal may be transmitted to a solenoid or a piezoelectric element, and the first actuator may be activated and transition to an action position based on the first signal.

At step 1210, the gun may transmit a second signal to a second actuator located in the displacement path of the sear component, so as to cause the second actuator to be displaced in a second direction based on the transmitting the second signal. The second direction may be substantially opposite the first direction. In some examples, the second signal may be transmitted to a solenoid or a piezoelectric element, and the second actuator may be activated and transition to an action position based on the second signal.

At step 1215, the gun may cause, based on (i) the transmitting the first signal to the first actuator and (ii) the transmitting the second signal to the second actuator, the sear component to be displaced. Causing the sear component to be displaced may result in a striker or hammer being released and the gun firing. The released striker or hammer may cause a firing pin to striker a cartridge primer, ignite a propellent, and propel a projectile through a barrel of the gun.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Figure 13:
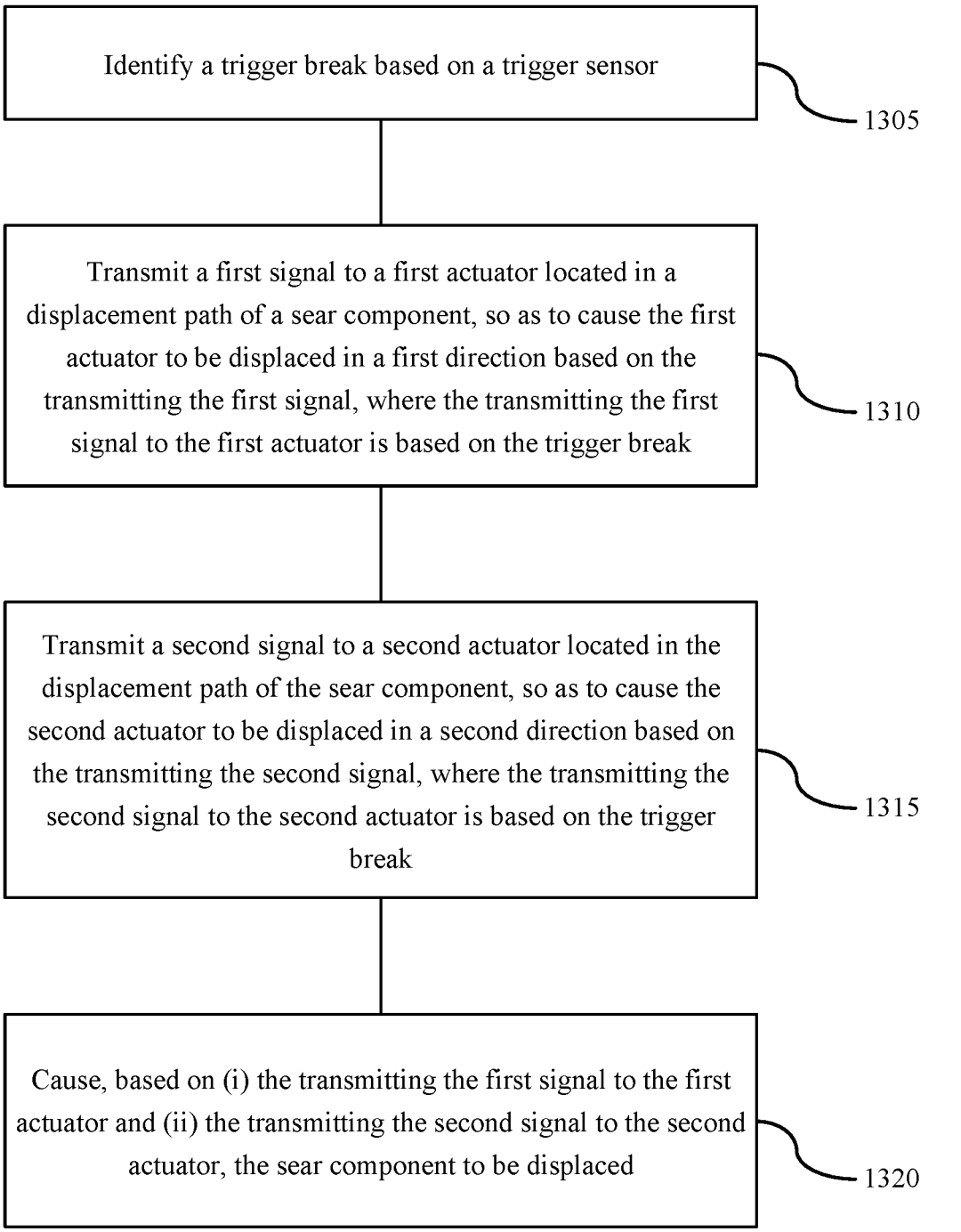
FIG. 13 illustrates an example of a flowchart that supports an electromechanical sear in accordance with aspects of the present disclosure.

FIG. 13 shows a flowchart illustrating a method 1300 of operating a gun that includes an electromechanical sear. The operations of the method 1300 may be implemented by a fire control manager, a gun or its components as described herein. For example, the operations of the method 1300 may be performed by a fire control manager 910 as described with reference to FIG. 9, a control platform 812 as described with reference to FIG. 8, a fire control manager 705 as described with reference to FIG. 7, or a fire control manager 415 as described with reference to FIG. 4. In some examples, a gun may execute a set of instructions to control the functional elements of the gun and to perform the described functions. Additionally or alternatively, the gun may perform aspects of the described functions using special-purpose hardware.

At step 1305, the gun may identify a trigger break based on a trigger sensor. The trigger sensor may be a Hall effect sensor, and the gun may identify the trigger break based on the trigger sensor generating a signal and an edge-triggered latching procedure. For example, the trigger may include a magnet which moves past the trigger sensor as the trigger passes a detent, the trigger sensor may generate a signal based on the magnet moving past the trigger sensor, and the gun (or fire control manager) may perform an edge-triggered latching procedure to identify a trigger break based on the signal generated by the trigger sensor.

At step 1310, the gun may transmit a first signal to a first actuator located in a displacement path of a sear component, so as to cause the first actuator to be displaced in a first direction based on the transmitting the first signal, where the transmitting the first signal to the first actuator is based on the trigger break.

At step 1315, the gun may transmit a second signal to a second actuator located in the displacement path of the sear component, so as to cause the second actuator to be displaced in a second direction based on the transmitting the second signal, where the transmitting the second signal to the second actuator is based on the trigger break.

At step 1320, the gun may cause, based on (i) the transmitting the first signal to the first actuator and (ii) the transmitting the second signal to the second actuator, the sear component to be displaced. Displacing the sear component may cause a striker or a hammer to be released and the gun to fire a projectile.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

EXAMPLES

Several aspects of the present disclosure are set forth examples. Note that, unless otherwise specified, all of these examples can be combined with one another. Accordingly, while a feature may be described in the context of a given example, the feature may be similarly applicable to other examples.

In some examples, the systems and techniques described herein relate to a method of operating a gun with a trigger, the method including: determining, at a fire control manager coupled with the gun, that the gun is to be fired based on an analysis of movement of the trigger; transmitting, in response to the determining that the gun is to be fired, a first signal to a first actuator located in a displacement path of a sear component, so as to cause the first actuator to be displaced in a first direction; transmitting, in response to the determining that the gun is to be fired, a second signal to a second actuator located in the displacement path of the sear component, so as to cause the second actuator to be displaced in a second direction different from the first direction; and causing, based on (i) the transmitting the first signal to the first actuator and (ii) the transmitting the second signal to the second actuator, movement of the sear component such that a striker, a hammer, or a firing pin is released.

In some examples, the systems and techniques described herein relate to a method of operating a gun, including: transmitting a first signal to a first actuator located in a displacement path of a sear component, so as to cause the first actuator to be displaced in a first direction based on the transmitting the first signal; transmitting a second signal to a second actuator located in the displacement path of the sear component, so as to cause the second actuator to be displaced in a second direction based on the transmitting the second signal; and causing, based on (i) the transmitting the first signal to the first actuator and (ii) the transmitting the second signal to the second actuator, the sear component to be displaced.

In some examples, the systems and techniques described herein relate to a method, further including: identifying a trigger break based on a trigger sensor, wherein the transmitting the first signal to the first actuator is based on the trigger break and the transmitting the second signal to the second actuator is based on the trigger break.

In some examples, the systems and techniques described herein relate to a method, wherein the first direction includes a positive direction along a longitudinal axis, and wherein the second direction includes a negative direction along the longitudinal axis.

In some examples, the systems and techniques described herein relate to a method, wherein the longitudinal axis is substantially parallel to a barrel of the gun.

In some examples, the systems and techniques described herein relate to a method, wherein the transmitting the first signal to the first actuator includes: directing electric current to a solenoid that is coupled with the first actuator to create a magnetic field, wherein the first actuator is displaced in the first direction based on a strength of the magnetic field. The first actuator may include and/or be electrically coupled with the solenoid.

In some examples, the systems and techniques described herein relate to a method, wherein the transmitting the second signal to the second actuator includes: directing second electric current to a second solenoid that is coupled with the second actuator to create a second magnetic field, wherein the second actuator is displaced in the second direction based on a strength of the second magnetic field. The second actuator may include and/or be electrically coupled with the second solenoid.

In some examples, the systems and techniques described herein relate to a method, further including: determining that a user is holding the gun, wherein the transmitting the first signal to the first actuator is in response to the determining that the user is holding the gun.

In some examples, the systems and techniques described herein relate to a method, wherein the determining that the user is holding the gun includes: receiving an indication of activation of a sensor coupled with the gun, wherein the sensor includes a user presence sensor or a biometric sensor.

In some examples, the systems and techniques described herein relate to a method, further including: determining that a user holding the gun is authorized to operate the gun, wherein the transmitting the first signal to the first actuator is in response to the determining that the user holding the gun is authorized to operate the gun.

In some examples, the systems and techniques described herein relate to a method, further including: causing, based on the sear component being displaced, a striker, a hammer, or a firing pin to be released such that the firing pin travels along a longitudinal axis that is substantially parallel to a barrel.

In some examples, the systems and techniques described herein relate to a method, wherein a spring applies force to the sear component along a transverse axis that is substantially perpendicular to a barrel, and wherein the causing the sear component to be displaced is based on the spring applying the force to the sear component.

In some examples, the systems and techniques described herein relate to an apparatus for controllably firing a projectile, the apparatus including: a sear component that is rotatable between a first position and a second position; a first actuator that is positioned so as to retain the sear component in the first position, wherein upon receiving a first signal, the first actuator is configured to move in a first direction; and a second actuator that is positioned so as to retain the sear component in the first position, wherein upon receiving a second signal, the second actuator is configured to move in a second direction different from the first direction; wherein when (i) the first actuator moves in the first direction and (ii) the second actuator moves in the second direction, the sear component is configured to rotate from the first position to the second position.

In some examples, the systems and techniques described herein relate to an apparatus, further including: a capacitor bank configured to selectively discharge electric current into a solenoid of the first actuator.

In some examples, the systems and techniques described herein relate to an apparatus, wherein the first actuator is configured to move based on the electric current discharged into the solenoid of the first actuator.

In some examples, the systems and techniques described herein relate to an apparatus, further including: a second capacitor bank configured to selectively discharge electric current into a solenoid of the second actuator.

In some examples, the systems and techniques described herein relate to an apparatus, further including: a spring applying force to the first actuator in a direction opposing the first direction such that the first actuator is, by default, located in a position that obstructs displacement of the sear component.

In some examples, the systems and techniques described herein relate to an apparatus, wherein the first actuator includes a leaf spring, and wherein the leaf spring is the spring.

In some examples, the systems and techniques described herein relate to an apparatus, wherein the first actuator is in contact with a coil spring wrapping a plunger of the first actuator, and wherein the coil spring is the spring.

In some examples, the systems and techniques described herein relate to an apparatus, further including: a chassis configured to house the sear component, the chassis including indicia indicating a manufacturer of the apparatus.

In some examples, the systems and techniques described herein relate to an apparatus, wherein the first actuator and the second actuator are coupled with an interior surface of the chassis.

In some examples, the systems and techniques described herein relate to an apparatus, wherein the first actuator and the second actuator are coupled with an exterior surface of the chassis.

In some examples, the systems and techniques described herein relate to an apparatus, wherein the first actuator and the second actuator are adhered to the chassis with a potting compound.

In some examples, the systems and techniques described herein relate to an apparatus, wherein the chassis includes a metal, an alloy, a polymer, or any combination thereof.

In some examples, the systems and techniques described herein relate to an apparatus, wherein the chassis is a result of a stamping manufacturing process or a machining manufacturing process.

In some examples, the systems and techniques described herein relate to an apparatus, wherein the sear component includes a gun sear or a gun sear linkage.

In some examples, the systems and techniques described herein relate to an apparatus for controllably firing a projectile, the apparatus including: means for applying force to a sear component at a proximate end of the sear component; means for obstructing the sear component at a distal end of the sear component such that the sear component is retained in a first position; means for releasing the sear component such that the sear component moves from the first position to a second position; and means for resetting the sear component such that the sear component returns to the first position. In some examples, the means for applying force to the sear is a force multiplier. In some examples, the means for applying force to the sear is a spring, a coil spring, or a spring oriented along a transverse axis. In some examples, the force multiplier, the spring, the coil spring, or the spring oriented along the transverse axis, stores energy from slide recoil or racking. In some examples, the means for obstructing the sear component is an actuator, an actuator block, an actuator plunger, a solenoid-based actuator, or a piezoelectric actuator. In some examples, the means for releasing the sear component is activating the actuator, an electromagnetic field, a signal, a solenoid-based actuator, or a piezoelectric actuator. In some examples, the means for resetting the sear component is a reset tab sear, an actuator spring, slide recoil, or racking the slide.

In some examples, the systems and techniques described herein relate to an apparatus, further including: means for identifying a trigger break, wherein the means for releasing the sear component is configured to release the sear component based on the means for identifying the trigger break successfully identifying a trigger break. In some examples, the means for identifying the trigger break is a Hall effect sensor, a fire control manager, a force threshold, a distance threshold, or a trigger detent.

In some examples, the systems and techniques described herein relate to an apparatus, further including: means for authenticating a user, wherein the means for releasing the sear component is configured to release the sear component based on the means for authenticating the user successfully authenticating a user. In some examples, the means for authenticating the user is a biometric sensor, a control platform, a fire control manager, a fingerprint sensor, an image sensor, an RFID sensor, or an authentication procedure.

In some examples, the systems and techniques described herein relate to a method of operating a gun with a trigger, the method further including: determining, at a processor, that the gun is to be fired based on an analysis of movement of the trigger, causing, by the processor in response to said determining, a first signal to be transmitted to a first actuator located in a displacement path of a sear component, so as to cause the first actuator to be displaced in a first direction, and causing, by the processor in response to said determining, a second signal to be transmitted to a second actuator located in the displacement path of the sear component, so as to cause the second actuator to be displaced in a second direction different than the first direction, wherein when (i) the first actuator is displaced in the first direction and (ii) the second actuator is displaced in the second direction, the sear component moves such that a striker, a hammer, or a firing pin is released.

In some examples the systems and techniques described herein relate to an apparatus for controllably firing a projectile, the apparatus including: a first actuator positioned such that the first actuator obstructs displacement of a sear component, wherein the first actuator is configured to move in a first direction, a second actuator positioned such that the second actuator obstructs displacement of the sear component, wherein the second actuator is configured to move in a second direction, and the sear component in a first position, wherein the first actuator and the second actuator prevent the sear component from rotating about a pivot into a second position, wherein the sear component is configured to rotate about the pivot into the second position based on the first actuator moving in the first direction and the second actuator moving in the second direction.

In some examples the systems and techniques described herein relate to an apparatus for controllably firing a projectile, the apparatus including: a sear component that is rotatable between a first position and a second position, a first actuator that is positioned so as to retain the sear component in the first position, wherein upon receiving a first signal indicative of a request to fire the firearm, the first actuator is configured to move in a first direction, and a second actuator that is positioned so as to retain the sear component in the first position, wherein upon receiving a second signal indicative of a request to fire the firearm, the second actuator is configured to move in a second direction different than the first direction, wherein when (i) the first actuator moves in the first direction and (ii) the second actuator moves in the second direction, the sear component is configured to rotate from the first position to the second position.

Remarks

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

In the figures, similar components or features may have the same reference label, and components of the same or similar type may be distinguished by appending a dash and a second label to the reference label (e.g., 105-*a* and 105-*b*). If just the first reference label is used in the specification, the description is applicable to any one of the similar components having the same first reference label regardless of the second label.

The Detailed Description provided herein, in connection with the appended figures (or drawings), describes example configurations and does not represent all the examples that may be implemented or that are within the scope of the claims. The term "example" used herein means "serving as an illustration or instance," and not "a preferred example." The Detailed Description enables a person having ordinary skill in the art to use or make use of the disclosure.

The functions, techniques, components, and illustrative blocks described herein may be implemented or performed with a general-purpose processor, a specific-purpose processor, a digital signal processor (DSP), a central processing unit (CPU), a graphics processing unit (GPU), a tensor processing unit (TPU), a neural processing unit (NPU), an image signal processor (ISP), a hardware security module (HSM), an application-specific integrated circuit (ASIC), a programmable logic device, such as a field-programmable gate array (FPGA), discrete hardware components, or any combination thereof designed to perform the functions described herein. In some cases, a general-purpose processor may be a microprocessor, while in some other cases, the general-purpose processor may be any processor, controller, microcontroller, or state machine. A processor may also be implemented as a combination of computing devices, such as a one or more microprocessors and one or more DSPs.

The functions described herein may be implemented in hardware and/or software (e.g., firmware) executed by a processor. If implemented in software executed by a processor, the functions may be stored on or transmitted over as instructions or code on a computer-readable medium. Features or components implementing functions may also be physically located at various locations, and different functions or portions of functions may be implemented at different physical locations.

Computer-readable media includes both non-transitory computer storage media and communication media. A non-transitory storage medium may be any available medium that may be accessed by a computer or component. For example, non-transitory computer-readable media may include RAM, SRAM, DRAM, ROM, EEPROM, flash memory, magnetic storage devices, or any other non-transitory medium that may be used to carry and/or store program code means in the form of instructions and/or data structures. The instructions and/or data structures may be accessed by a general-purpose computer, a special-purpose computer, a general-purpose processor, a special-purpose processor, or a hardware component. A computer-readable media may include any combination of the above, and a compute component may include computer-readable media.

What is claimed is:

1. An apparatus for controllably firing a projectile, the apparatus comprising:

a sear component that is configured to be retained in a first position by default and selectively released into a second position;

means for applying force to the sear component while the sear component is in the first position such that the sear component is biased towards the second position;

a trigger sensor that is configured to generate an output in response to determining that a trigger has moved at least a threshold distance;

a pair of actuators that are positioned to retain the sear component in the first position and, when actuated, move in different directions to permit the sear component to move to the second position, wherein the sear component is configured to move to the second position based on (i) the means for applying force to the sear component applying force to the sear component and (ii) the pair of actuators moving in the different directions; and a reset tab that is configured to reset the sear component from the second position to the first position, wherein the reset tab is configured to contact a slide component as the slide component recoils in a rearward direction away from a muzzle of the apparatus so as to reset the sear component to the first position.

2. An apparatus for controllably firing a projectile, the apparatus comprising:

a sear component that is configured to be retained in a first position by default and selectively released into a second position;

means for applying force to the sear component while the sear component is in the first position such that the sear component is biased towards the second position;

a pair of actuators that are positioned to retain the sear component in the first position and, when actuated, move in different directions to permit the sear component to move to the second position; and a reset tab that is configured to reset the sear component from the second position to the first position, wherein the reset tab is configured to contact a slide component as the slide component recoils in a rearward direction away from a muzzle of the apparatus so as to reset the sear component to the first position.

3. The apparatus of claim 2, further comprising:

a trigger sensor that is configured to generate an output in response to determining that a trigger has moved at least a threshold distance, wherein the pair of actuators are configured to actuate in response to the output.

4. The apparatus of claim 2, further comprising:

means for authenticating users, wherein the pair of actuators are configured to move in the different directions based on the means for authenticating users successfully authenticating a user as an authorized operator of the apparatus.

5. The apparatus of claim 2, further comprising:

means for detecting a presence of a user, wherein the pair of actuators are configured to move in the different directions based on the means for detecting the presence of the user generating a signal.

6. The apparatus of claim 2, further comprising:

means for storing electric charge, wherein the pair of actuators are configured to be actuated in response to the means for storing electric charge directing electric current to the pair of actuators.

7. The apparatus of claim 2, further comprising:

means for identifying trigger breaks, wherein the means for identifying trigger breaks is configured to identify trigger breaks based on an analysis of movement of a trigger.

8. The apparatus of claim 2, wherein the sear component is configured to be released into the second position based on (i) the means for applying force to the sear component biasing the sear component towards the second position and (ii) a first actuator of the pair of actuators moving in a first direction and (iii) a second actuator of the pair of actuators moving in a second direction.

9. The apparatus of claim 2, wherein the different directions comprise a first direction and a second direction, and wherein the first direction comprises a positive direction along a longitudinal axis that is parallel to a bore axis of a barrel of the apparatus, and wherein the second direction comprises a negative direction along the longitudinal axis.

10. The apparatus of claim 2, wherein the different directions comprise a first direction and a second direction, and wherein the first direction comprises a positive direction along a transverse axis that is perpendicular to a bore axis of a barrel of the apparatus, and wherein the second direction comprises a negative direction along the transverse axis.

11. The apparatus of claim 2, wherein the sear component is at least 25 millimeters in length.

12. An apparatus for controllably firing a projectile, the apparatus comprising:

a sear component that is moveable between a first position and a second position;

a pair of actuators that naturally retain the sear component in the first position and, when actuated, move in different directions to permit the sear component to move to the second position, wherein each actuator of the pair of actuators is separately actuatable; and a reset tab that is configured to reset the sear component into the first position based on a mechanical component colliding with the reset tab as the mechanical component recoils rearward in a direction that is away from a muzzle of the apparatus.

13. The apparatus of claim 12, wherein an actuator of the pair of actuators comprises a reset spring configured to bias the actuator into a position that obstructs movement of the sear component.

14. The apparatus of claim 12, wherein an actuator of the pair of actuators comprises a solenoid.

15. The apparatus of claim 12, wherein an actuator of the pair of actuators comprises a piezoelectric element.

* * * * *